US007703275B2

(12) United States Patent
Asanuma et al.

(10) Patent No.: US 7,703,275 B2
(45) Date of Patent: Apr. 27, 2010

(54) EXHAUST PURIFICATION DEVICE OF COMPRESSION IGNITION TYPE INTERNAL COMBUSTION ENGINE

(75) Inventors: Takamitsu Asanuma, Mishima (JP); Shinya Hirota, Susono (JP); Tomihisa Oda, Namazu (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 1317 days.

(21) Appl. No.: 10/542,595

(22) PCT Filed: Nov. 29, 2004

(86) PCT No.: PCT/JP2004/018087

§ 371 (c)(1),
(2), (4) Date: Jul. 18, 2005

(87) PCT Pub. No.: WO2005/054637

PCT Pub. Date: Jun. 16, 2005

(65) Prior Publication Data

US 2006/0053778 A1 Mar. 16, 2006

(30) Foreign Application Priority Data

Dec. 1, 2003 (JP) ..... 2004-401597

(51) Int. Cl.
*F01N 3/00* (2006.01)

(52) U.S. Cl. ..... 60/286; 60/295; 60/297; 60/301; 60/303

(58) Field of Classification Search ..... 60/286, 60/295, 297, 301, 303
See application file for complete search history.

(56) References Cited

U.S. PATENT DOCUMENTS

| | | | | |
|---|---|---|---|---|
| 6,167,696 | B1 * | 1/2001 | Maaseidvaag et al. | 60/274 |
| 2003/0101713 | A1 | 6/2003 | Dalla Betta et al. | |

FOREIGN PATENT DOCUMENTS

| | | |
|---|---|---|
| JP | A 9-100716 | 4/1997 |
| JP | A 11-33414 | 2/1999 |
| JP | A 11-50894 | 2/1999 |
| JP | A 11-81991 | 3/1999 |
| JP | A 2000-145439 | 5/2000 |
| JP | A 2000-227021 | 8/2000 |
| JP | A 2000-345829 | 12/2000 |
| JP | A 2000-345832 | 12/2000 |
| JP | A 2002-38939 | 2/2002 |
| JP | A 2002-242665 | 8/2002 |
| JP | A 2002-266625 | 9/2002 |
| JP | A 2003-97255 | 4/2003 |

* cited by examiner

*Primary Examiner*—Thomas E Denion
*Assistant Examiner*—Diem Tran
(74) *Attorney, Agent, or Firm*—Oliff & Berridge, PLC

(57) ABSTRACT

A fuel adding valve (14), an HC adsorbing and oxidation catalyst (11), and a $NO_x$ storing catalyst (12) are successively arranged in an exhaust passage of an internal combustion engine toward the downstream side. When the $NO_x$ storing catalyst (12) should release $NO_x$, particulate fuel is added from the fuel adding valve (14). This fuel is adsorbed once at the HC adsorbing and oxidation catalyst (11), then gradually evaporates to make the air-fuel ratio of the exhaust gas flowing into the $NO_x$ storing catalyst (12) rich. Due to this, $NO_x$ is released from the $NO_x$ storing catalyst (12).

17 Claims, 15 Drawing Sheets

(A)

(B)

(A)

(B)

(A)

(B)

(A)

(B)

(A)

(B)

(A)

(B)

(C)

EXHAUST PURIFICATION DEVICE OF COMPRESSION IGNITION TYPE INTERNAL COMBUSTION ENGINE

TECHNICAL FIELD

The present invention relates to an exhaust purification device of a compression ignition type internal combustion engine.

BACKGROUND ART

Known in the art is an internal combustion engine having arranged in an engine exhaust passage an $NO_x$ storing catalyst which stores $NO_x$ contained in exhaust gas when the air-fuel ratio of the inflowing exhaust gas is lean and releases the stored $NO_x$ when the oxygen concentration in the inflowing exhaust gas falls. In this internal combustion engine, the $NO_x$ produced when burning fuel under a lean air-fuel ratio is stored in the $NO_x$ storing catalyst.

However, when using such an $NO_x$ storing catalyst, it is necessary to make the $NO_x$ storing catalyst release the $NO_x$ before the $NO_x$ storing capability of the $NO_x$ storing catalyst becomes saturated. In this case, if making the air-fuel ratio of the exhaust gas flowing into the $NO_x$ storing catalyst rich, it is possible to make the $NO_x$ storing catalyst release the $NO_x$ and to reduce the released $NO_x$. Therefore, in conventional internal combustion engines, the $NO_x$ storing catalyst is made to release $NO_x$ by making the air-fuel ratio in the combustion chamber rich or by feeding fuel into the engine exhaust passage upstream of the $NO_x$ storing catalyst to make the air-fuel ratio of the exhaust gas flowing into the $NO_x$ storing catalyst rich.

However, to make an $NO_x$ storing catalyst release $NO_x$ well, sufficiently gasified rich air-fuel ratio exhaust gas has to be made to flow into the $NO_x$ storing catalyst. In this case, if making the air-fuel ratio in the combustion chamber rich, the sufficiently gasified rich air-fuel ratio exhaust gas flows into the $NO_x$ storing catalyst, so it is possible to make the $NO_x$ storing catalyst release the $NO_x$ well. However, if making the air-fuel mixture in the combustion chamber rich, there is the problem that a large amount of soot is produced. Further, if injecting additional fuel into the expansion stroke or exhaust stroke so as to make the air-fuel ratio of the exhaust gas exhausted from the combustion chamber rich, the injected fuel sticks to the inside walls of the cylinder bore, i.e., bore flushing occurs.

As opposed to this, when injecting fuel into the engine exhaust passage upstream of an $NO_x$ storing catalyst, the problems of soot being produced or bore flushing occurring as explained above no longer arise. However, when injecting fuel into the engine exhaust passage upstream of the $NO_x$ storing catalyst, there is the problem that the injected fuel is not sufficiently gasified and therefore the $NO_x$ storing catalyst cannot be made to release $NO_x$ well.

On the other hand, known in the art is an internal combustion engine arranging a hydrocarbon, that is, HC adsorbing catalyst for adsorbing HC contained in exhaust gas in the engine exhaust passage upstream of the $NO_x$ storing catalyst (see Japanese Unexamined Patent Publication (Kokai) No. 2003-97255). In this internal combustion engine, the HC produced when burning fuel under a lean air-fuel ratio is adsorbed by the HC adsorbing catalyst and the $NO_x$ produced at that time is stored in the $NO_x$ storing catalyst.

However, in this internal combustion engine, when the temperature of the HC adsorbing catalyst becomes near the activation temperature, that is, near 200° C., the oxidation reaction of the adsorbed HC becomes active and as a result the oxygen in the exhaust gas is rapidly consumed, so the oxygen concentration in the exhaust gas rapidly falls. Therefore, at this time, if additionally supplying a small amount of fuel, it is possible to make the air-fuel ratio of the exhaust gas rich. Therefore, in this internal combustion engine, it is detected whether a sufficient amount of oxygen has been consumed at the HC adsorbing catalyst, and the air-fuel ratio of the exhaust gas is made rich when a sufficient amount of oxygen is being consumed in the HC adsorbing catalyst so as to make the $NO_x$ storing catalyst release $NO_x$.

However, in this internal combustion engine, the air-fuel ratio in the combustion chamber is made rich. Fuel is not injected into the engine exhaust passage. Therefore, the above problem arises. Further, in this internal combustion engine, the period when the temperature of the HC adsorbing catalyst becomes near the activation temperature, that is, the period when a sufficient amount of oxygen is consumed in the HC adsorbing catalyst, is limited, so the temperature of the HC adsorbing catalyst will not become the activation temperature in the period required as seen from the action of the $NO_x$ storing catalyst releasing the $NO_x$ and consequently there is the problem that the $NO_x$ storing catalyst cannot release $NO_x$ when the $NO_x$ storing catalyst has to release the $NO_x$.

DISCLOSURE OF THE INVENTION

An object of the present invention is to provide an exhaust purification device of a compression ignition type internal combustion engine designed to enable an $NO_x$ storing catalyst to release $NO_x$ well even when feeding fuel into the engine exhaust passage upstream of the $NO_x$ storing catalyst so as to make the $NO_x$ storing catalyst release $NO_x$.

To achieve the above object, according to the present invention, provision is made of fuel adding means for adding particulate fuel into exhaust gas, an HC adsorbing and oxidation catalyst arranged in an engine exhaust passage downstream of the fuel adding means for adsorbing and oxidizing hydrocarbons contained in the exhaust gas, and an $NO_x$ storing catalyst arranged in the engine exhaust passage downstream of the HC adsorbing and oxidation catalyst for storing $NO_x$ contained in the exhaust gas when the air-fuel ratio of the inflowing exhaust gas is lean and releasing the stored $NO_x$ when the air-fuel ratio of the inflowing exhaust gas becomes the stoichiometric air-fuel ratio or rich, particulate fuel is added from the fuel adding means when making the air-fuel ratio of the exhaust gas flowing into the $NO_x$ storing catalyst rich to make the $NO_x$ storing catalyst release $NO_x$, the amount of addition of particulate fuel at this time is set to an amount whereby the air-fuel ratio of the exhaust gas flowing into the HC absorbing and oxidation catalyst becomes a rich air-fuel ratio smaller than the rich air-fuel ratio when flowing into the $NO_x$ storing catalyst, and after the added particulate fuel is adsorbed at the HC adsorbing and oxidation catalyst, the majority of the adsorbed fuel is oxidized in the HC adsorbing and oxidation catalyst and the air-fuel ratio of the exhaust gas flowing into the $NO_x$ storing catalyst is made rich over a longer period than when the air-fuel ratio of the exhaust gas flowing into the HC adsorbing and oxidation catalyst is made rich.

BEST MODE FOR CARRYING OUT THE INVENTION

Figure 1:
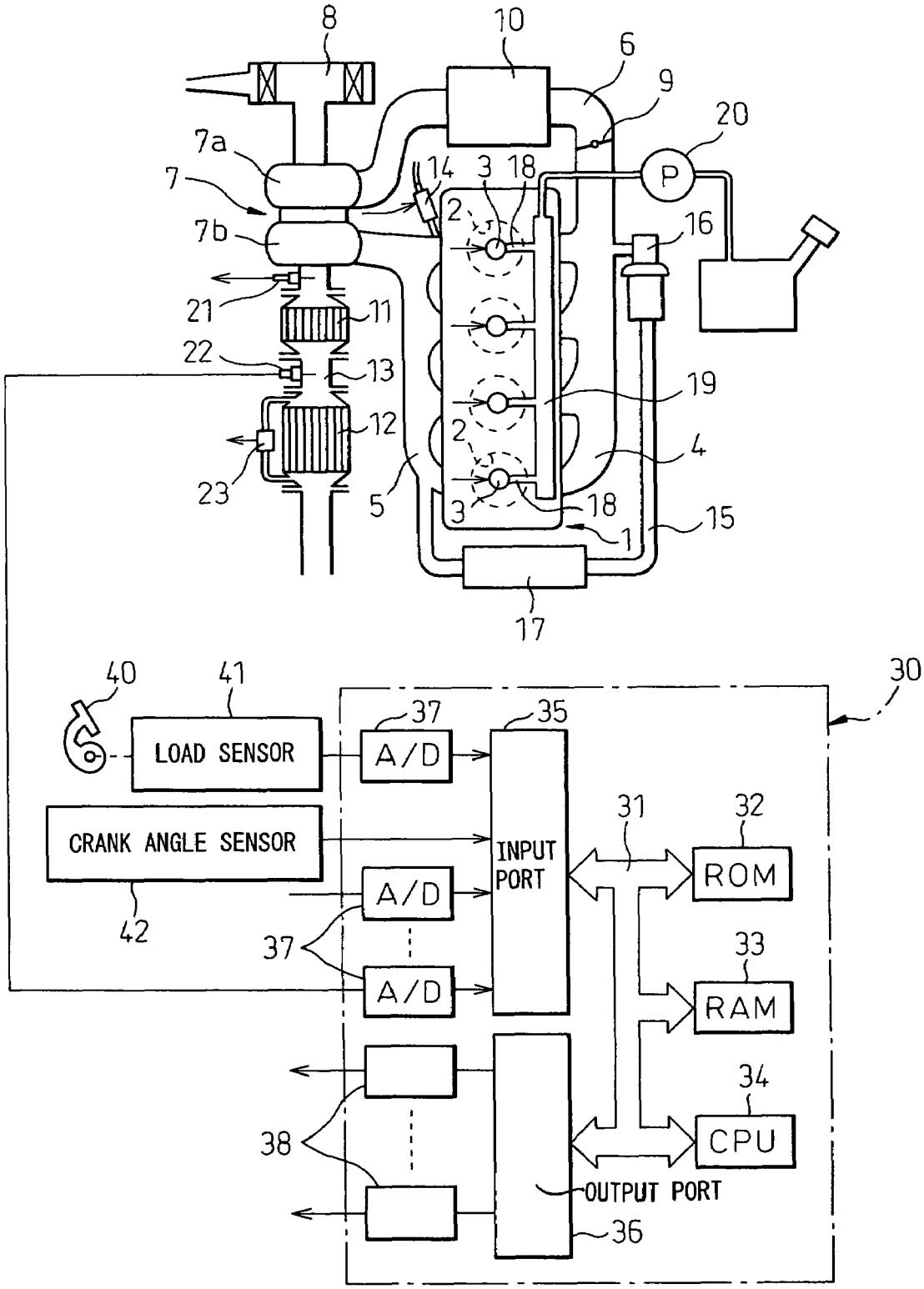
FIG. 1 is an overview of a compression ignition type internal combustion engine.

FIG. 1 shows an overview of a compression ignition type internal combustion engine.

Referring to FIG. 1, 1 indicates an engine body, 2 a combustion chamber of each cylinder, 3 an electronically controlled fuel injector for injecting fuel into each combustion chamber 2, 4 an intake manifold, and 5 an exhaust manifold. The intake manifold 4 is connected through an intake duct 6 to an outlet of a compressor 7*a* of an exhaust turbocharger 7. The inlet of the compressor 7*a* is connected to an air cleaner 8. Inside the intake duct 6 is arranged a throttle valve 9 driven by a step motor. Further, around the intake duct 6 is arranged a cooling device 10 for cooling the intake air flowing through the inside of the intake duct 6. In the embodiment shown in FIG. 1, the engine cooling water is guided into the cooling device 10. The engine cooling water cools the intake air. On the other hand, the exhaust manifold 5 is connected to an inlet of an exhaust turbine 7*b* of the exhaust turbocharger 7, while the outlet of the exhaust turbine 7*b* is connected to an inlet of an HC adsorbing and oxidation catalyst 11. Further, the outlet of the HC adsorbing and oxidation catalyst 11 is connected through an exhaust pipe 13 to an $NO_x$ storing catalyst 12. The exhaust manifold 5 is provided with a fuel adding valve 14 for adding mist state, that is, particulate state fuel into the exhaust gas. In this embodiment of the present invention, this fuel is diesel oil.

The exhaust manifold 5 and the intake manifold 4 are interconnected through an exhaust gas recirculation (hereinafter referred to as an "EGR") passage 15. The EGR passage 15 is provided with an electronically controlled EGR control valve 16. Further, around the EGR passage 15 is arranged a cooling device 17 for cooling the EGR gas flowing through the inside of the EGR passage 15. In the embodiment shown in FIG. 1, the engine cooling water is guided into the cooling device 17. The engine cooling water cools the EGR gas. On the other hand, each fuel injector 3 is connected through a fuel feed tube 18 to a common rail 19. This common rail 19 is supplied with fuel from an electronically controlled variable discharge fuel pump 20. The fuel supplied into the common rail 19 is supplied through each fuel feed tube 18 to the fuel injector 3.

An electronic control unit 30 is comprised of a digital computer provided with a ROM (read only memory) 32, a RAM (random access memory) 33, a CPU (microprocessor) 34, an input port 35, and an output port 36 all connected to each other by a bidirectional bus 31. The inlet of the HC adsorbing and oxidation catalyst 11 is provided with a temperature sensor 21 for detecting the temperature of the exhaust gas flowing into the HC adsorbing and oxidation catalyst 11, while the exhaust passage 13 is provided with a temperature sensor 22 for detecting the temperature of the exhaust gas flowing out from the HC adsorbing and oxidation catalyst 11. The output signals of the temperature sensors 21 and 22 are input through corresponding AD converters 37 to the input port 35. Further, the $NO_x$ storing catalyst 12 is provided with a differential pressure sensor 23 for detecting the differential pressure before and after the $NO_x$ storing catalyst 12. The output signal of the differential pressure sensor 23 is input through the corresponding AD converter 37 to the input port 35.

An accelerator pedal 40 has a load sensor 41 generating an output voltage proportional to the amount of depression L of the accelerator pedal 40 connected to it. The output voltage of the load sensor 41 is input through a corresponding AD converter 37 to the input port 35. Further, the input port 35 has a crank angle sensor 42 generating an output pulse each time the crankshaft turns for example by 15 degrees connected to it. On the other hand, the output port 36 is connected through corresponding drive circuits 38 to the fuel injectors 3, throttle valve 9 step motor, fuel adding valve 14, EGR control valve 16, and fuel pump 20.

Figure 2:
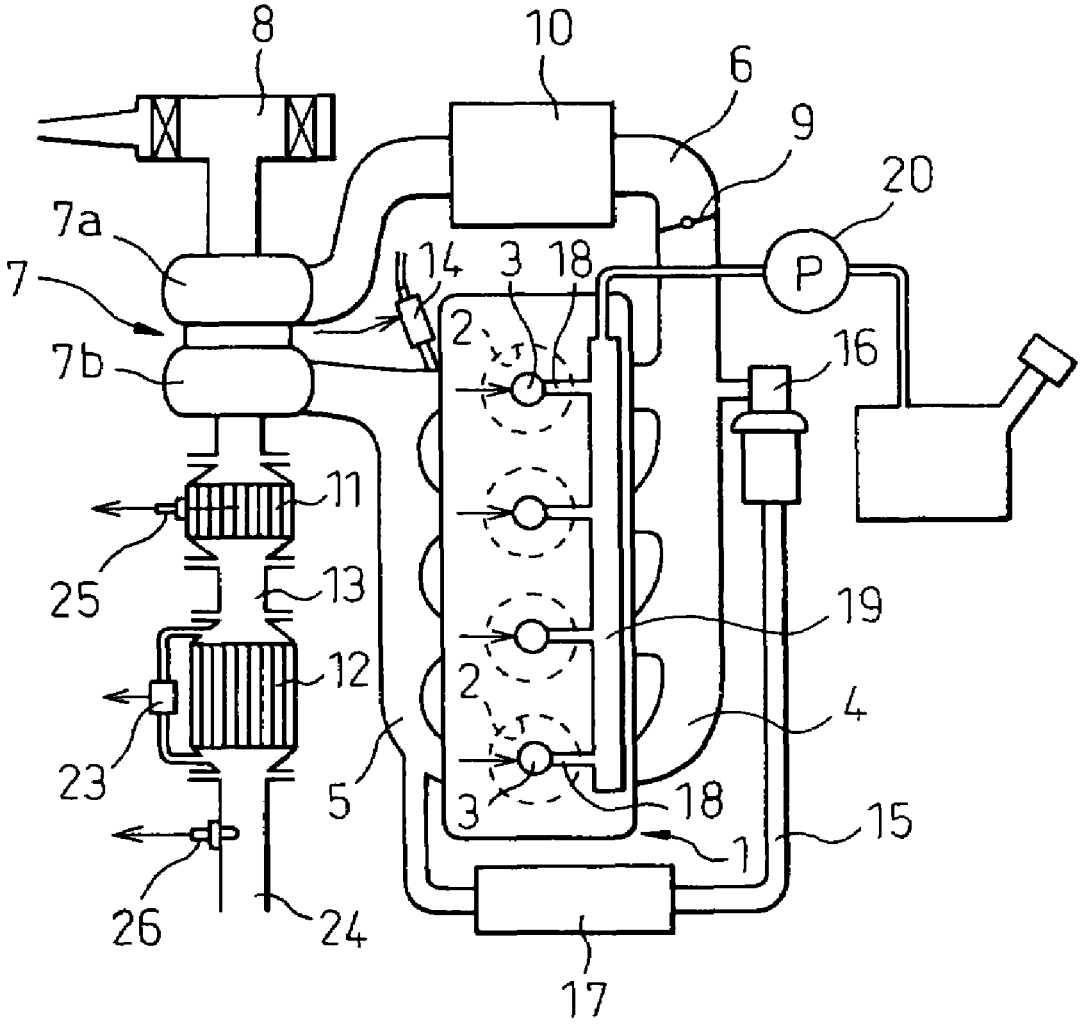
FIG. 2 is an overview of another embodiment of a compression ignition type internal combustion engine.

FIG. 2 shows another embodiment of a compression ignition type internal combustion engine. In this embodiment, the HC adsorbing and oxidation catalyst 11 is provided with a temperature sensor 25 for detecting the temperature of the HC adsorbing and oxidation catalyst 11, while the exhaust passage 24 connected to the outlet of the $NO_x$ storing catalyst 12 is provided inside it with an air-fuel ratio sensor 26 for detecting the air-fuel ratio of the exhaust gas.

First, explaining the $NO_x$ storing catalyst 12 shown in FIG. 1 and FIG. 2, the $NO_x$ storing catalyst 12 is carried on a three-dimensional mesh structure monolith carrier or pellet carriers or is carried on a honeycomb structure particulate filter. In this way, the $NO_x$ storing catalyst 12 can be carried on various types of carriers, but below, the explanation will be made of the case of carrying the $NO_x$ storing catalyst 12 on a particulate filter.

Figure 3:
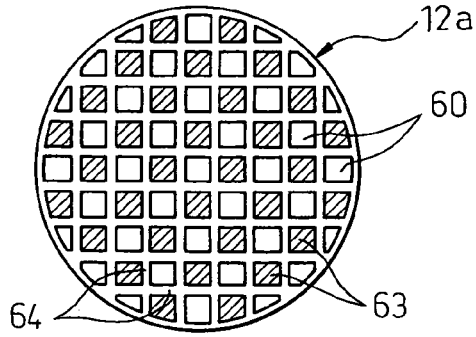
FIG. 3 gives views of the structure of a particulate filter.
Figure 3:
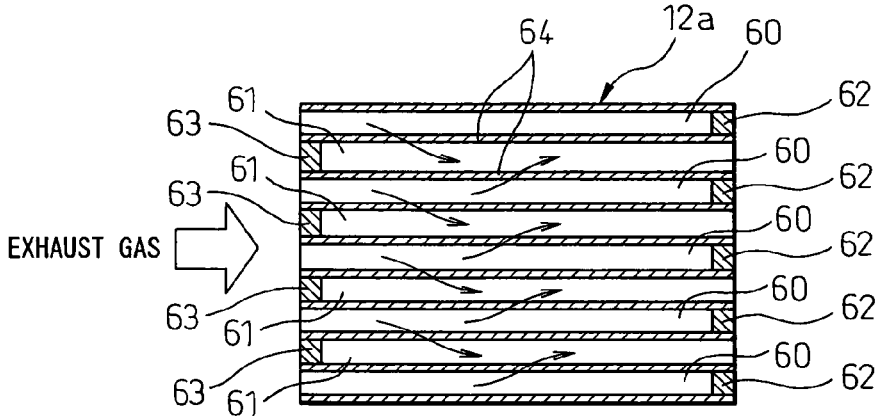

FIGS. 3(A) and (B) show the structure of the particulate filter 12*a* carrying the $NO_x$ storing catalyst 12. Note that FIG. 3(A) is a front view of the particulate filter 12*a*, while FIG. 3(B) is a side sectional view of the particulate filter 12*a*. As shown in FIGS. 3(A) and (B), the particulate filter 12*a* forms a honeycomb structure and is provided with a plurality of exhaust flow passages 60 and 61 extending in parallel with each other. These exhaust flow passages are comprised by exhaust gas inflow passages 60 with downstream ends sealed by plugs 62 and exhaust gas outflow passages 61 with upstream ends sealed by plugs 63. Note that the hatched portions in FIG. 3(A) show plugs 63. Therefore, the exhaust gas inflow passages 60 and the exhaust gas outflow passages 61 are arranged alternately through thin wall partitions 64. In other words, the exhaust gas inflow passages 60 and the exhaust gas outflow passages 61 are arranged so that each exhaust gas inflow passage 60 is surrounded by four exhaust gas outflow passages 61, and each exhaust gas outflow passage 61 is surrounded by four exhaust gas inflow passages 60.

The particulate filter 12*a* is formed from a porous material such as for example cordierite. Therefore, the exhaust gas flowing into the exhaust gas inflow passages 60 flows out into the adjoining exhaust gas outflow passages 61 through the surrounding partitions 64 as shown by the arrows in FIG. 3(B).

Figure 4:
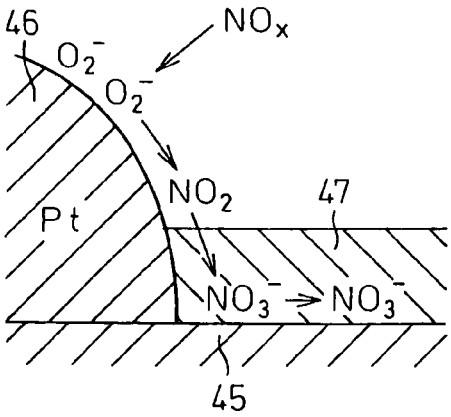
FIG. 4 is a sectional view of a surface part of a catalyst carrier of an $NO_x$ storing catalyst.
Figure 4:
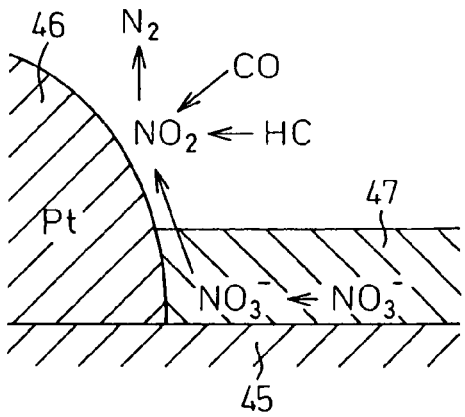

When the $NO_x$ storing catalyst 12 is carried on the particulate filter 12*a* in this way, the peripheral walls of the exhaust gas inflow passages 60 and exhaust gas outflow passages 61, that is, the surfaces of the two sides of the partitions 64 and inside walls of the fine holes of the partitions 64, carry a catalyst carrier comprised of alumina. FIGS. 4(A) and (B) schematically show the cross-section of the surface part of this catalyst carrier 45. As shown in FIGS. 4(A) and (B), the catalyst carrier 45 carries a precious metal catalyst 46 diffused on its surface. Further, the catalyst carrier 45 is formed with a layer of an $NO_x$ absorbent 47 on its surface.

In this embodiment of the present invention, platinum Pt is used as the precious metal catalyst 46. As the ingredient forming the $NO_x$ absorbent 47, for example, at least one element selected from potassium K, sodium Na, cesium Cs, or another alkali metal, barium Ba, calcium Ca, or another alkali earth, lanthanum La, yttrium Y, or another rare earth may be used.

If the ratio of the air and fuel (hydrocarbons) supplied to the engine intake passage, combustion chambers 2, and exhaust passage upstream of the $NO_x$ storing catalyst 12 is referred to as the "air-fuel ratio of the exhaust gas", the $NO_x$ absorbent 47 performs an $NO_x$ absorption and release action of storing the $NO_x$ when the air-fuel ratio of the exhaust gas is lean and releasing the stored $NO_x$ when the oxygen concentration in the exhaust gas falls.

That is, if explaining this taking as an example the case of using barium Ba as the ingredient forming the $NO_x$ absorbent 47, when the air-fuel ratio of the exhaust gas is lean, that is, when the oxygen concentration in the exhaust gas is high, the NO contained in the exhaust gas is oxidized on the platinum Pt 46 such as shown in FIG. 4(A) to become $NO_2$, then is absorbed in the $NO_x$ absorbent 47 and diffuses in the $NO_x$ absorbent 47 in the form of nitric acid ions $NO_3^-$ while bonding with the barium oxide BaO. In this way, the $NO_x$ is absorbed in the $NO_x$ absorbent 47. So long as the oxygen concentration in the exhaust gas is high, $NO_2$ is produced on the surface of the platinum Pt 46. So long as the $NO_x$ absorbing capability of the $NO_x$ absorbent 47 is not saturated, the $NO_2$ is absorbed in the $NO_x$ absorbent 47 and nitric acid ions $NO_3^-$ are produced.

As opposed to this, by making the air-fuel ratio of the exhaust gas rich or the stoichiometric air-fuel ratio, since the oxide concentration in the exhaust gas falls, the reaction proceeds in the reverse direction ($NO_3^- \rightarrow NO_2$) and therefore, as shown in FIG. 4(B), the nitric acid ions $NO_3^-$ in the $NO_x$ absorbent 47 are released from the $NO_x$ absorbent 47 in the form of $NO_2$. Next, the released $NO_x$ is reduced by the unburned hydrocarbons or CO included in the exhaust gas.

In this way, when the air-fuel ratio of the exhaust gas is lean, that is, when burning fuel under a lean air-fuel ratio, the $NO_x$ in the exhaust gas is absorbed in the $NO_x$ absorbent 47. However, if continuing to burn fuel under a lean air-fuel ratio, during that time the $NO_x$ absorbing capability of the $NO_x$ absorbent 47 will end up becoming saturated and therefore $NO_x$ will end up no longer being able to be absorbed by the $NO_x$ absorbent 47. Therefore, in this embodiment according to the present invention, before the absorbing capability of the $NO_x$ absorbent 47 becomes saturated, a reducing agent is supplied from the reducing agent supply valve 14 so as to temporarily make the air-fuel ratio of the exhaust gas rich and thereby release the $NO_x$ from the $NO_x$ absorbent 47.

Now, as explained above, if adding fuel from the fuel adding valve 14 to make the air-fuel ratio of the exhaust gas rich, the $NO_x$ absorbent 47 releases $NO_x$ and the released $NO_x$ is reduced by the unburned HC and CO contained in the exhaust gas. In this case, if the added fuel is in the liquid state, theoretically even if the air-fuel ratio of the exhaust gas becomes rich, the $NO_x$ absorbent 47 will not release $NO_x$. Further, when the fuel is in the liquid state, the $NO_x$ will not be reduced. That is, to make the $NO_x$ absorbent 47 release $NO_x$ and to reduce the released $NO_x$, it is necessary to make the air-fuel ratio of the gaseous ingredients in the exhaust gas flowing into the $NO_x$ storing catalyst 12 rich.

In the present invention, the fuel added from the fuel adding valve 14 is in the particulate state. Part of the fuel becomes a gaseous, but the majority is in the liquid state. In the present invention, even if the majority of the fuel added is in the liquid state, the HC adsorbing and oxidation catalyst 11 is arranged upstream of the $NO_x$ storing catalyst 12 so that the fuel flowing into the $NO_x$ storing catalyst 12 becomes gaseous. Next, the HC adsorbing and oxidation catalyst 11 will be explained.

Figure 5:
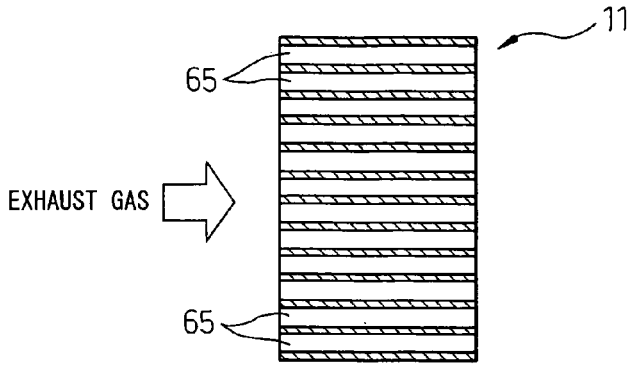
FIG. 5 is a side sectional view of an HC adsorbing and oxidation catalyst.
Figure 6:
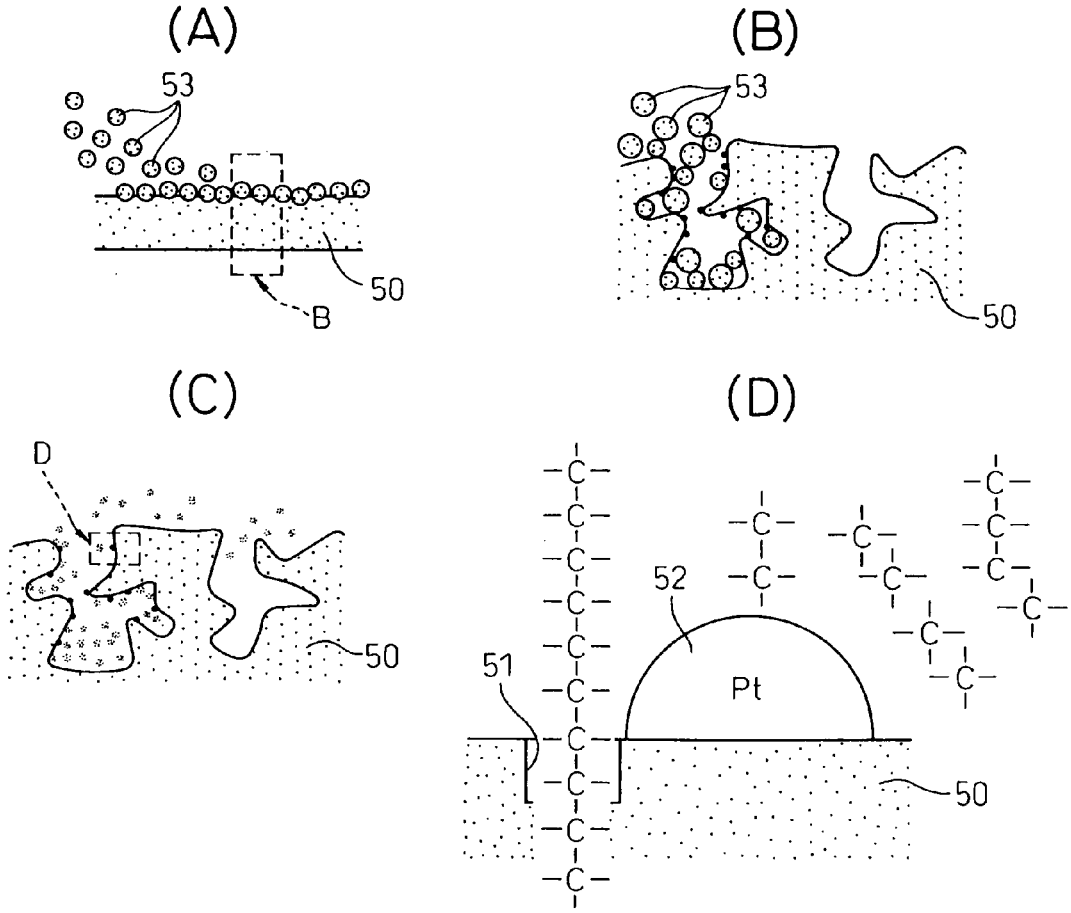
FIG. 6 is a sectional view of a surface part of a catalyst carrier of an HC adsorbing and oxidation catalyst.

FIG. 5 is a side sectional view of the HC adsorbing and oxidation catalyst 11. As shown in FIG. 5, the HC adsorbing and oxidation catalyst 11 forms a honeycomb structure and provides a plurality of exhaust gas passages 65 extending straight. The HC adsorbing and oxidation catalyst 11 is formed from a material with a large relative surface area having a porous structure such as zeolite. The base of the HC adsorbing and oxidation catalyst 11 shown in FIG. 5 is made of a type of zeolite, that is, mordenite. FIGS. 6(A) to (D) schematically show cross-sections of the surface part of the HC adsorbing and oxidation catalyst 11. Note that FIG. 6(B) shows an enlarged view of the part B in FIG. 6(A), FIG. 6(C) shows the same cross-section as FIG. 6(B), and FIG. 6(D) shows an enlarged view of the part D in FIG. 6(C). As will be understood from FIGS. 6(B) and (C), the surface of the HC adsorbing and oxidation catalyst 11 forms a relief, rough surface shape. On the surface having this rough surface shape, as shown in FIG. 6(D), a large number of fine pores 51 are formed and a precious metal catalyst 52 made of platinum Pt is carried dispersed.

Figure 7:
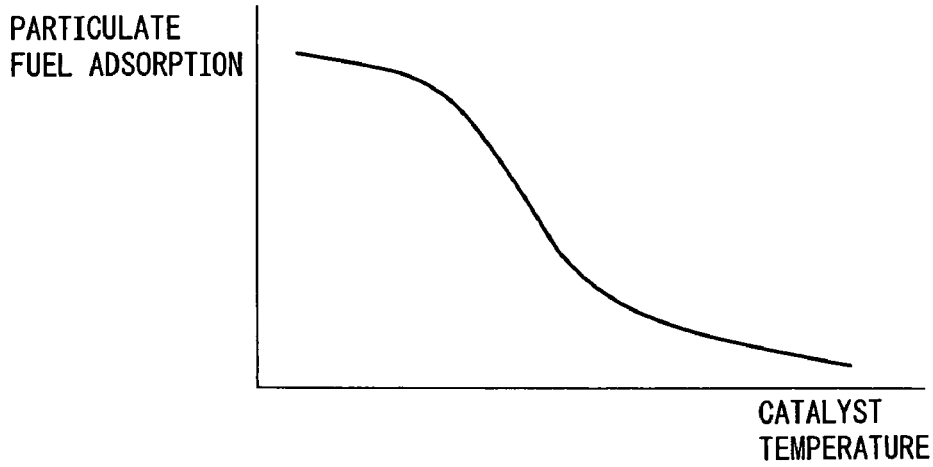
FIG. 7 is a view of an amount of fuel adsorption.
Figure 7:
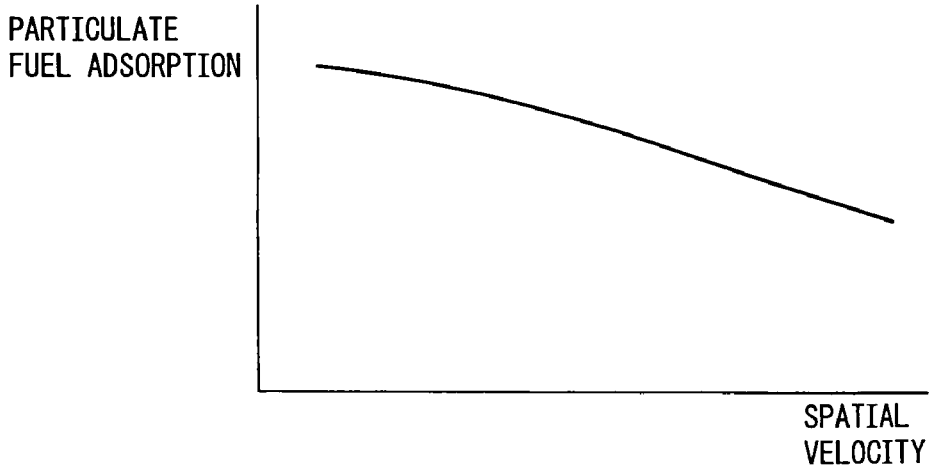

When particulate fuel is added from the fuel adding valve 14, part of the fuel evaporates and becomes gaseous, but the majority is adsorbed on the surface of a base 50 in the form of particles. FIGS. 6(A) and (B) show the state of adsorption of the fuel particles 53. The ratio of adsorption of fuel when fuel is adsorbed in the liquid state becomes considerably high compared with the ratio of adsorption of gaseous fuel. Note that the amount of adsorption of the particulate fuel which the HC adsorbing and oxidation catalyst 11 is able to adsorb, as shown in FIG. 7(A), becomes greater the lower the temperature of the HC adsorbing and oxidation catalyst 11. Further, if the spatial velocity of the flow of exhaust gas in the HC adsorbing and oxidation catalyst 11 becomes faster, that is, if the flow rate of the exhaust gas becomes faster, the amount of the fuel added from the fuel adding valve 14 which is gasified and the amount of the particulate fuel passing straight through the exhaust passages 65 in the HC adsorbing and oxidation catalyst 11 will increase. Therefore, the amount of adsorption of the particulate fuel which the HC adsorbing and oxidation catalyst 11 can adsorb, as shown in FIG. 7(B), decreases the faster the spatial velocity.

Next, as shown in FIGS. 6(C) and (D), the fuel particles 53 adsorbed on the surface of the base 50 gradually evaporate to form gaseous fuel. This gaseous fuel is mainly comprised of HC with a large number of carbon atoms. The HC with the large number of carbon atoms is cracked at the acid points on the surface of the zeolite or on the precious metal catalyst 52 and converted to HC with a small number of carbon atoms. The converted gaseous HC immediately reacts with the oxygen in the exhaust gas to be oxidized. The majority of the fuel particles 53 adsorbed on the surface of the base 50 reacts with the oxygen in the exhaust gas, so almost all of the oxygen contained in the exhaust gas is consumed. As a result, the oxygen concentration in the exhaust gas falls and the $NO_x$ storing catalyst 12 releases the $NO_x$.

On the other hand, at this time, the exhaust gas contains residual gaseous HC, so the air-fuel ratio of the exhaust gas becomes rich. This gaseous HC flows into the $NO_x$ storing catalyst 12, where the gaseous HC reduces the $NO_x$ released from the $NO_x$ storing catalyst 12.

Figure 8:
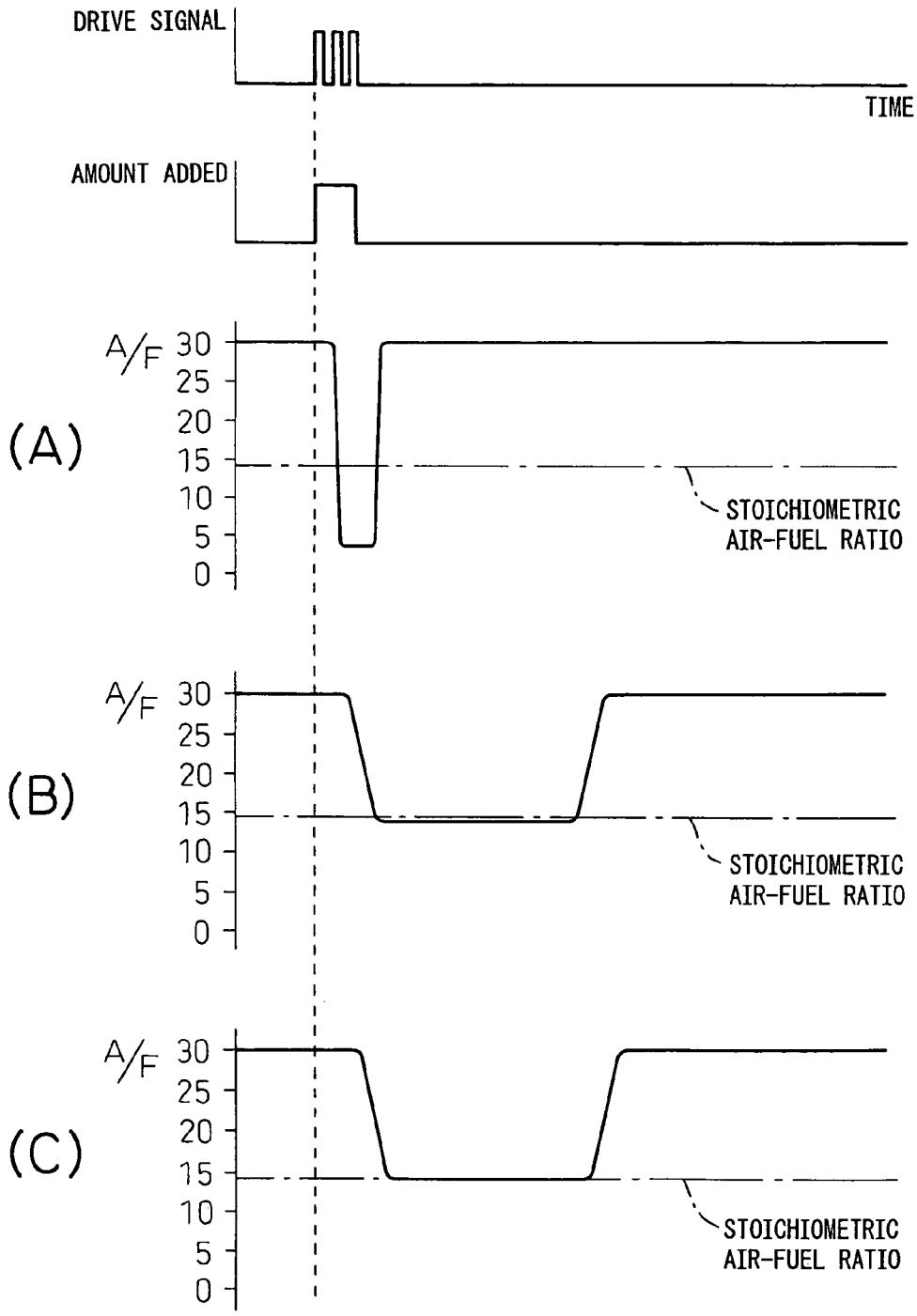
FIG. 8 is a view of the change in the air-fuel ratio of exhaust gas.

FIG. 8 shows the amount of addition of fuel from the fuel adding valve 14 and the air-fuel ratio A/F of the exhaust gas at the time of engine low speed, low load operation. Note that in FIG. 8, (A) shows the air-fuel ratio A/F of the exhaust gas flowing into the HC adsorbing and oxidation catalyst 11, (B) shows the air-fuel ratio A/F of the exhaust gas flowing out from the HC adsorbing and oxidation catalyst 11 and flowing into the $NO_x$ storing catalyst 12, and (C) shows the air-fuel ratio A/F of the exhaust gas flowing out from the $NO_x$ storing catalyst 12.

In this embodiment of the present invention, when the $NO_x$ storing catalyst 12 should release $NO_x$, as shown in FIG. 8, a drive signal comprised of a plurality of continuous pulses is supplied to the fuel adding valve 14. At this time, in actuality, the fuel continues to be continuously added while these continuous pulses are supplied. While fuel is being supplied from the fuel adding valve 14, the air-fuel ratio of the exhaust gas flowing into the HC adsorbing and oxidation catalyst 11, as shown in FIG. 8(A), becomes a considerably rich air-fuel ratio of up to 5.

On the other hand, when fuel is added from the fuel adding valve 14, the fuel particles are adsorbed on the HC adsorbing and oxidation catalyst 11, then the fuel gradually evaporates from the fuel particles and, as explained above, is cracked and reformed. Part of the fuel evaporated from the fuel particles or the reformed fuel reacts with the oxygen contained in the exhaust gas to be oxidized, whereby the oxygen concentration in the exhaust gas falls. On the other hand, the excess fuel, that is, the excess HC is exhausted from the HC adsorbing and oxidation catalyst 11. As a result, the air-fuel ratio A/F of the exhaust gas flowing out from the HC adsorbing and oxidation catalyst 11 becomes just slightly rich. That is, the fuel gradually evaporates from the fuel particles adsorbed on the HC adsorbing and oxidation catalyst 11 and the air-fuel ratio A/F of the exhaust gas flowing out from the HC adsorbing and oxidation catalyst 11 continues to be just slightly rich until the amount of the adsorbed fuel particles becomes small. Therefore, as shown in FIG. 8(B), the air-fuel ratio A/F of the exhaust gas flowing out from the HC adsorbing and oxidation catalyst 11 continues to be just slightly rich over a considerable time after the action of addition of fuel from the fuel adding valve 14 ends.

If the air-fuel ratio A/F of the exhaust gas flowing out from the HC adsorbing and oxidation catalyst 11 and flowing into the $NO_x$ storing catalyst 12 becomes rich, $NO_x$ is released from the $NO_x$ storing catalyst 12 and the released $NO_x$ is reduced by the unburned HC and CO. In this case, as explained above, the unburned HC flowing into the $NO_x$ storing catalyst 12 is reformed at the HC adsorbing and oxidation catalyst 11. Therefore, the released $NO_x$ is reduced well by the unburned HC. As will be understood from FIG. 8(C), while the action of release of $NO_x$ from the $NO_x$ storing catalyst 12 and the action of reduction are performed, the air-fuel ratio A/F of the exhaust gas flowing out from the $NO_x$ storing catalyst 12 is maintained at substantially the stoichiometric air-fuel ratio.

In this way, in the present invention, when making the air-fuel ratio of the exhaust gas flowing into the $NO_x$ storing catalyst 12 rich so as to make the $NO_x$ storing catalyst 12 release $NO_x$, particulate fuel is added from the fuel adding valve 14. The amount of addition of the particulate fuel at this time is set to an amount so that the air-fuel ratio of the exhaust gas flowing into the HC adsorbing and oxidation catalyst 11 becomes a rich air-fuel ratio smaller than the rich air-fuel ratio when flowing into the $NO_x$ storing catalyst 12, in the example shown in FIG. 8, less than half of that rich air-fuel ratio.

On the other hand, the particulate fuel added at this time is adsorbed on the HC adsorbing and oxidation catalyst 11, then the majority of the adsorbed fuel is oxidized in the HC adsorbing and oxidation catalyst 11, and the air-fuel ratio of the exhaust gas flowing into the $NO_x$ storing catalyst 12 becomes rich for a time longer than the time when the air-fuel ratio of the exhaust gas flowing into the HC adsorbing and oxidation catalyst 11 becomes rich, in the example shown in FIG. 8, several times the time.

In this way, in the present invention, by adsorbing and holding the particulate fuel added from the fuel adding valve 14 in the HC adsorbing and oxidation catalyst 11 once, then making the adsorbed and held particulate fuel evaporate a little at a time from the HC adsorbing and oxidation catalyst 11, the air-fuel ratio of the exhaust gas flowing into the $NO_x$ storing catalyst 12 is made rich for a long time. In this case, to make the $NO_x$ storing catalyst 12 release as large an amount of $NO_x$ as possible, it is sufficient to make the time during which the air-fuel ratio of the exhaust gas flowing into the $NO_x$ storing catalyst 12 is rich longer. For this purpose, it becomes necessary to increase the amount of fuel adsorbed and held at the HC adsorbing and oxidation catalyst 11 as much as possible.

Giving an example, it is learned that in a compression ignition internal combustion engine where the amount of intake air per second becomes 10 (g) at the time of engine low speed, low load operation, if injecting particulate fuel from the fuel adding valve 14 for about 400 msec, the air-fuel ratio of the exhaust gas flowing into the $NO_x$ storing catalyst 12 will have a rich air-fuel ratio of about 14.0 over about 2 seconds and that at that time, $NO_x$ will be released well from the $NO_x$ storing catalyst 12. At this time, the air-fuel ratio of the exhaust gas immediately downstream of the fuel adding valve 14, that is, the air-fuel ratio of the exhaust gas flowing into the HC adsorbing and oxidation catalyst 11, becomes a rich air-fuel ratio of about 4.4.

Explaining this in a bit more detail, in this compression ignition internal combustion engine, at the time of engine low speed, low load operation, the air-fuel ratio A/F is about 30. Therefore, since A/F=10 (g/sec)/F=30, the amount of fuel injected becomes F ⅓ (g/sec). On the other hand, to produce a rich air-fuel ratio of 14, since A/F=10 (g/sec)/F=14, 5/7 (g/sec) of fuel becomes necessary. Therefore, to produce a rich air-fuel ratio of 14, the amount of additional fuel to be added from the fuel adding valve 14 becomes 5/7 (g/sec)−⅓ (g/sec)=8/21 (g/sec). To produce a rich air-fuel ratio of 14 over 2 seconds, it is necessary to add 16/21 (g) of fuel from the fuel adding valve 14. If adding this fuel in 400 msec, the air-fuel ratio of the exhaust gas at this time becomes about 4.4.

Figure 9:
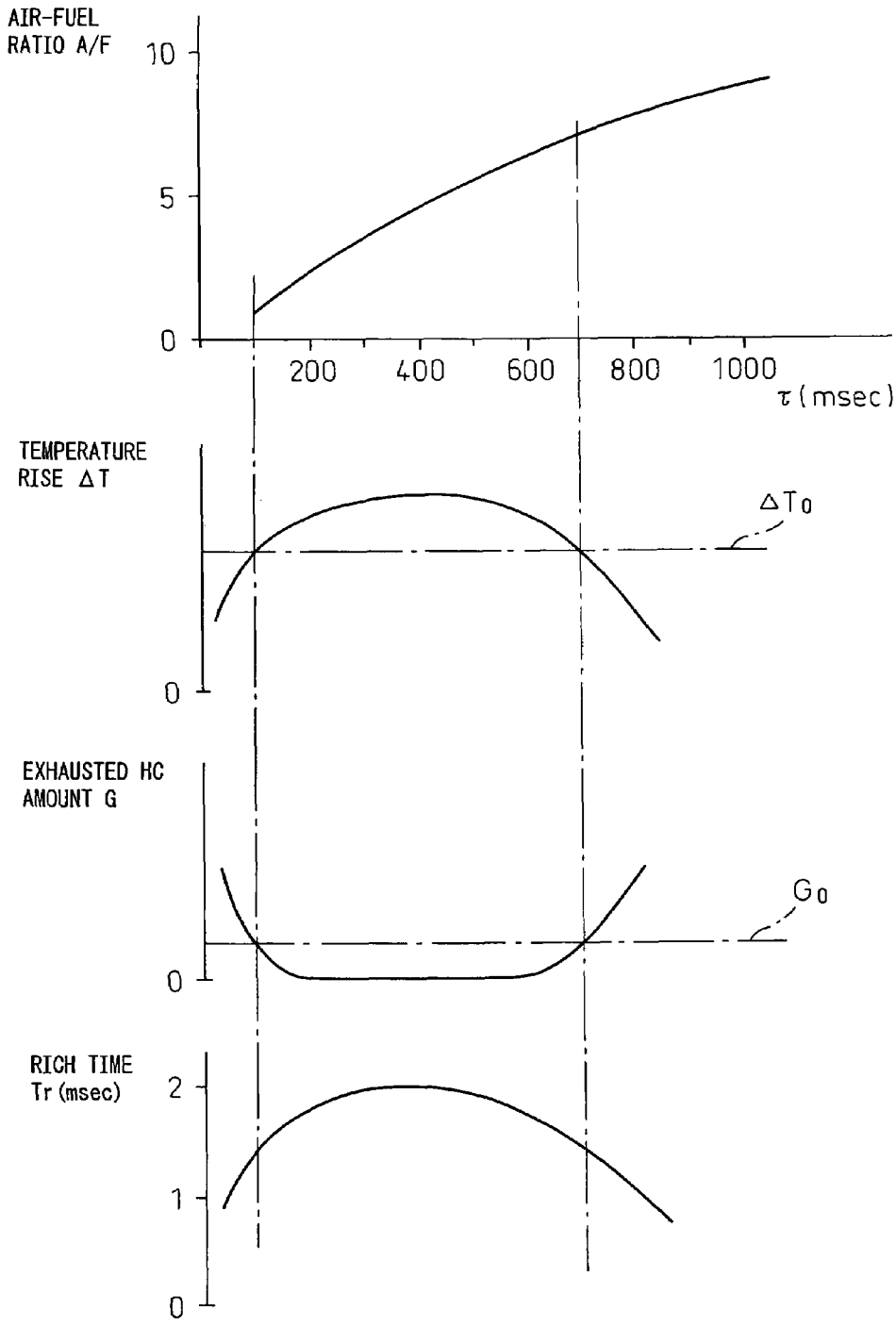
FIG. 9 is a view of the relationship between a fuel addition time and an air-fuel ratio A/F of exhaust gas, a temperature rise ΔT, exhausted HC amount G, and a rich time.

In this way, at the time of engine low speed, low load operation in this internal combustion engine, if trying to produce a rich air-fuel ratio of 14 over 2 seconds, it is necessary to supply 16/21 (g) of fuel from the fuel adding valve 14. In this case, if trying to supply this amount of fuel in a short time, for example, in 100 msec, it is necessary to raise the injection pressure of the fuel adding valve 14. However, if raising the injection pressure of the fuel adding valve 14, the fuel is made finer at the time of injection, so the amount of fuel which becomes a gas is increased and therefore the amount of fuel adsorbed at the HC adsorbing and oxidation catalyst 11 is reduced. That is, if the amount of fuel adsorbed on the HC adsorbing and oxidation catalyst 11 decreases, the time during which the air-fuel ratio becomes rich becomes smaller. As opposed to this, when supplying 16/21 (g) of fuel, if reducing the amount of supply per unit time, for example, if making the time of addition of fuel from the fuel adding valve 14 1000 msec, the amount of evaporation of fuel from the HC adsorbing and oxidation catalyst 11 per unit time becomes smaller and the air-fuel ratio of the exhaust gas is difficult to be made rich. FIG. 9 shows this.

That is, FIG. 9 shows the air-fuel ratio A/F of the exhaust gas flowing into the HC adsorbing and oxidation catalyst 11, the temperature rise ΔT of the exhaust gas flowing out from the HC adsorbing and oxidation catalyst 11, the exhausted HC amount G exhausted from the $NO_x$ storing catalyst 12, and the rich time of the exhaust gas flowing into the $NO_x$ storing catalyst 12 when changing the fuel addition time τ (msec) from the fuel adding valve 14.

As explained above, if making the fuel addition time from the fuel adding valve 14 shorter, the amount of fuel adsorbed at the HC adsorbing and oxidation catalyst 11 is reduced. As a result, the amount of evaporation of fuel from the HC adsorbing and oxidation catalyst 11 becomes smaller, so the oxidation action of the HC becomes weaker, the temperature rise ΔT falls, and the rich time becomes shorter. Further, at this time, the amount of fuel carried off by the flow of exhaust gas in the fuel supplied from the fuel adding valve 14 increases, so the exhausted HC amount G increases.

On the other hand, if making the fuel addition time from the fuel adding valve 14 longer, as explained above, the amount of fuel adsorbed per unit time at the HC adsorbing and oxidation catalyst 11 is reduced. As a result, the amount of evaporation of fuel from the HC adsorbing and oxidation catalyst 11 becomes smaller, so the oxidation action of the HC becomes weaker, the temperature rise ΔT falls, and the rich time becomes shorter. On the other hand, even after the action of release of $NO_x$ from the $NO_x$ storing catalyst 12 ends, HC continues to evaporate from the HC adsorbing and oxidation catalyst 11, so the exhausted HC amount G increases.

The fuel added when adding fuel from the fuel adding valve 14 is exhausted into the atmosphere, so that fuel is completely wasted. Therefore, it is necessary to suppress the amount of exhaust of the added fuel into the atmosphere, that is, the exhausted HC amount G, to an allowable value $G_0$ or less. The exhausted HC amount G being the allowable value $G_0$ or less, if looked at differently, means that the HC is engaging in an oxidation reaction and oxygen is being sufficiently consumed. Therefore, the exhausted HC amount G being the allowable value $G_0$ or less corresponds to the temperature rise ΔT being at least a predetermined setting $\Delta T_0$.

That is, when adding fuel from the fuel adding valve 14, it is necessary to determine the time τ of addition of the additional fuel so that the exhausted HC amount G becomes the allowable value $G_0$ or less and temperature rise ΔT becomes the set value $\Delta T_0$ or more. Therefore, in this embodiment of the present invention, the time τ of addition of the additional fuel is set to from about 100 (msec) to about 700 (msec). If expressing this by the air-fuel ratio A/F, the air-fuel ratio A/F when the time τ of addition is 100 (msec) becomes about 1, while the air-fuel ratio A/F when the time τ of addition is 700 (msec) becomes about 7, so in this embodiment of the present invention, at the time of engine low speed, low load operation, the amount of addition of particulate fuel added from the fuel adding valve 14 to make the $NO_x$ storing catalyst 12 release $NO_x$ is set to an amount giving an air-fuel ratio of the exhaust gas flowing into the HC adsorbing and oxidation catalyst 11 of about 1 to about 7.

Figure 10:
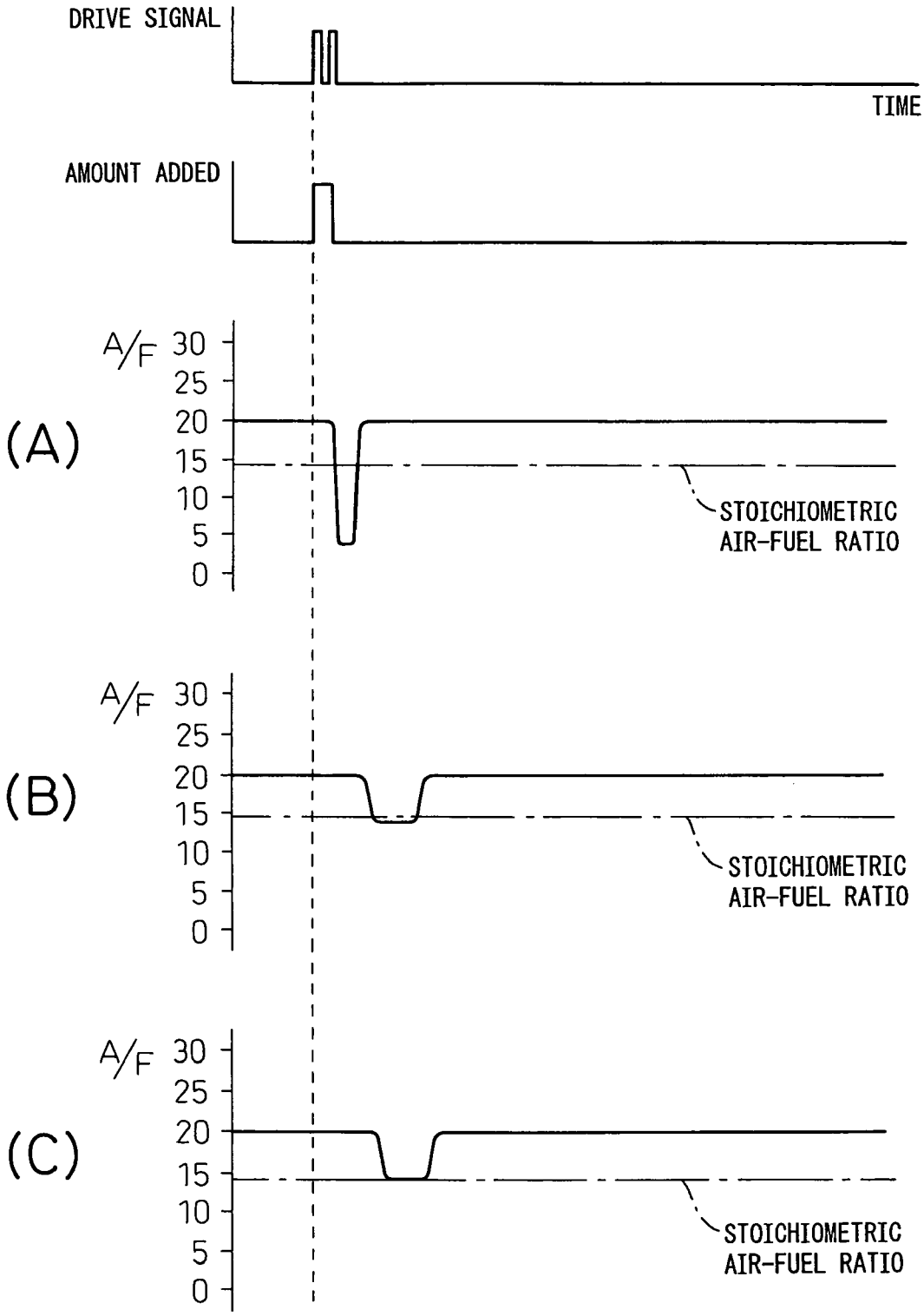
FIG. 10 is a view of the change in the air-fuel ratio of exhaust gas.

FIG. 10 shows the air-fuel ratio at the same locations as FIG. 8 at the time of an engine high speed, high load operation. At the time of an engine high speed, high load operation, the temperature of the HC adsorbing and oxidation catalyst 11 becomes higher and the spatial velocity of the exhaust gas flowing through the HC adsorbing and oxidation catalyst 11 becomes higher compared with the time of engine low speed, low load operation, so, as will be understood from FIGS. 7(A) and (B), the amount of fuel which the HC adsorbing and oxidation catalyst 11 can adsorb falls considerably. Therefore, as will be understood if comparing FIG. 10 and FIG. 8, the amount of fuel added from the fuel adding valve 14 is made smaller at the time of engine high speed, high load operation compared with the time of engine low speed, low load operation.

Note that as shown in FIG. 10, at the time of engine high speed, high load operation, the air-fuel ratio is about 20, so even if the fuel added is reduced, the air-fuel ratio of the exhaust gas can be made rich. However, the time during which the air-fuel ratio of the exhaust gas can be made rich becomes considerably shorter compared with the time of engine low speed, low load operation.

Figure 11:
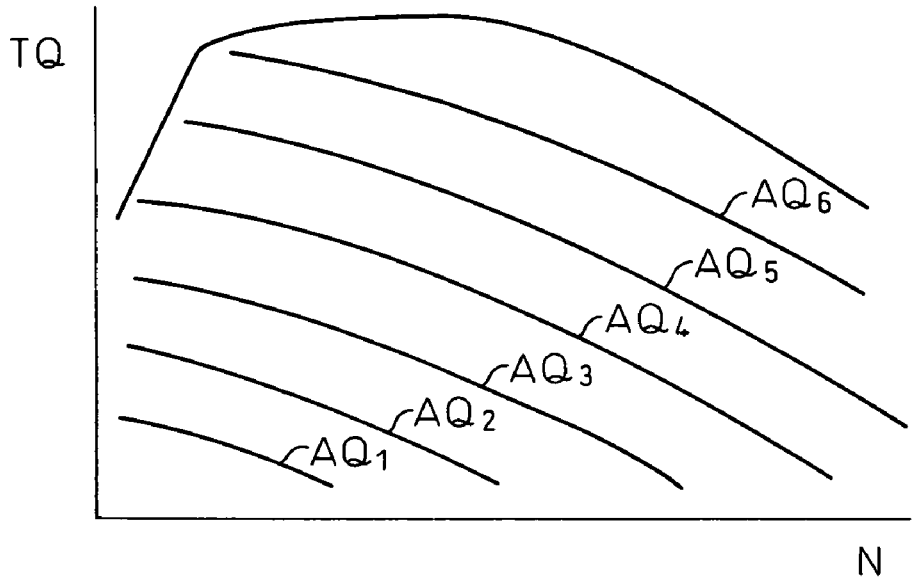
FIG. 11 is a view of an amount of fuel addition.
Figure 11:
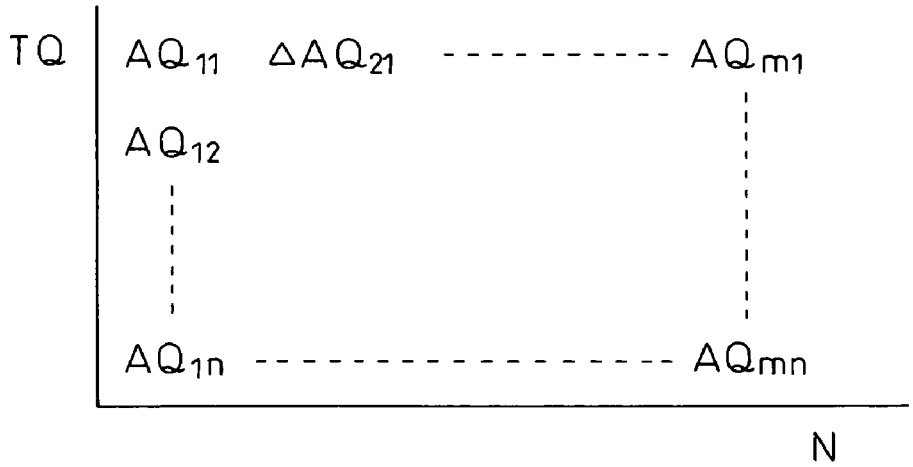

FIG. 11(A) shows the amount of fuel AQ added from the fuel adding valve 14 when $NO_x$ should be released from the $NO_x$ storing catalyst 12. The amount of fuel added becomes gradually smaller in the order of $AQ_1$, $AQ_2$, $AQ_3$, $AQ_4$, $AQ_5$, and $AQ_6$. Note that in FIG. 11(A), the ordinate TQ shows the output torque, while the abscissa N shows the engine speed. Therefore, the amount of fuel AQ to be added becomes smaller the greater the output torque TQ, that is, the higher the temperature of the HC adsorbing and oxidation catalyst 11, while becomes smaller the higher the engine speed N, that is, the greater the flow rate of the exhaust gas. The amount of fuel AQ to be added is stored in the form of a map as shown in FIG. 11(B) in advance in the ROM 32.

Figure 12:
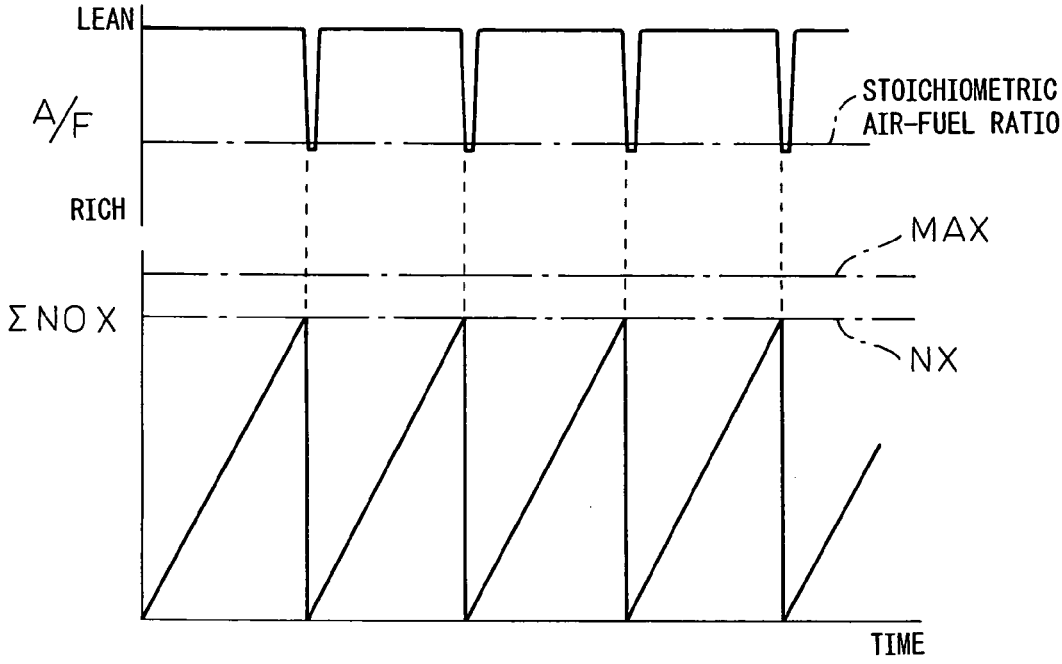
FIG. 12 is a view of $NO_x$ release control.
Figure 12:
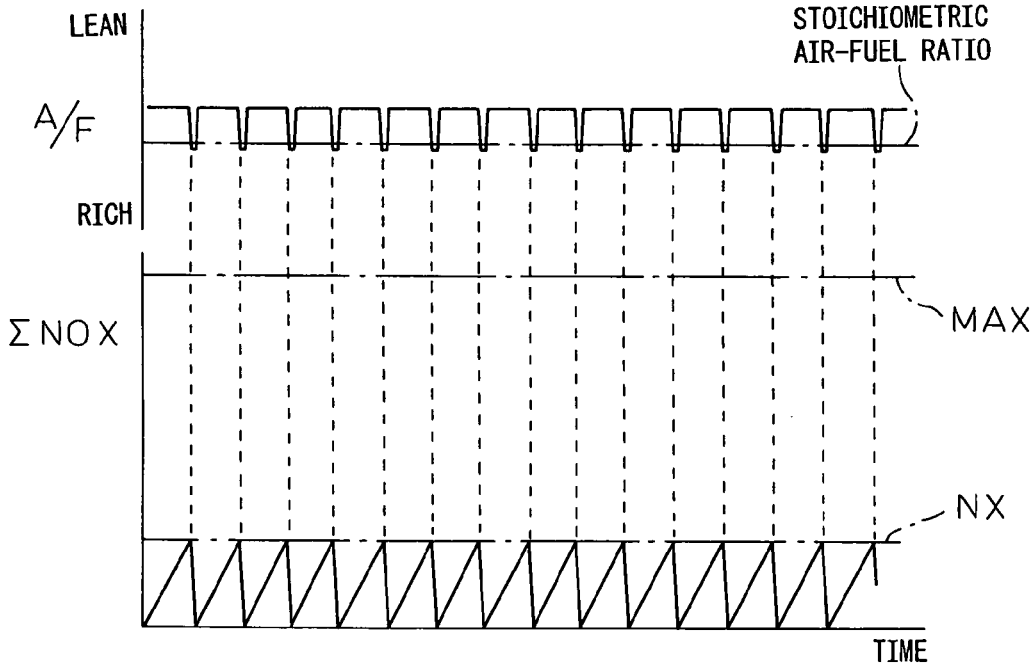
Figure 13:
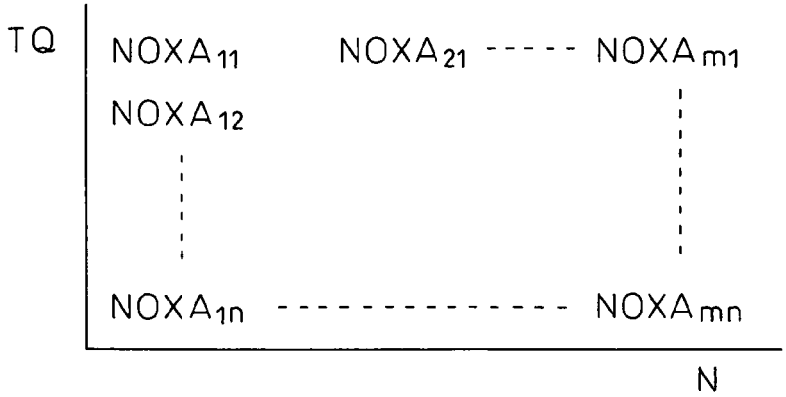
FIG. 13 is a view of a map etc. of a stored $NO_x$ amount NOXA.
Figure 13:
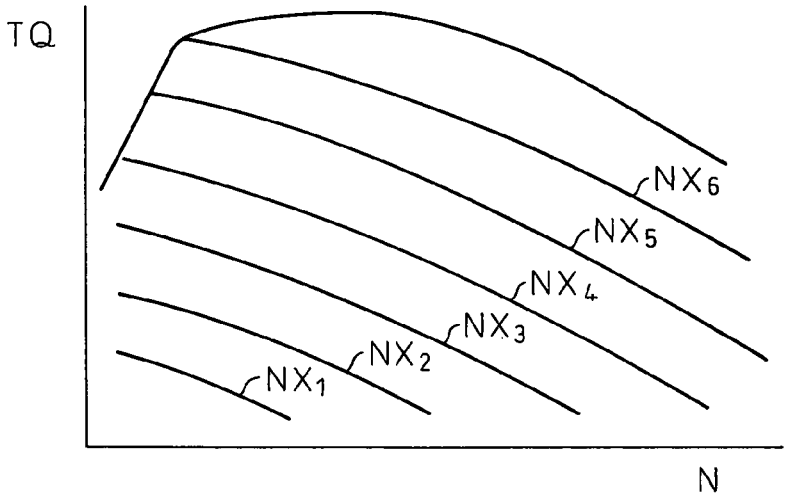
Figure 13:
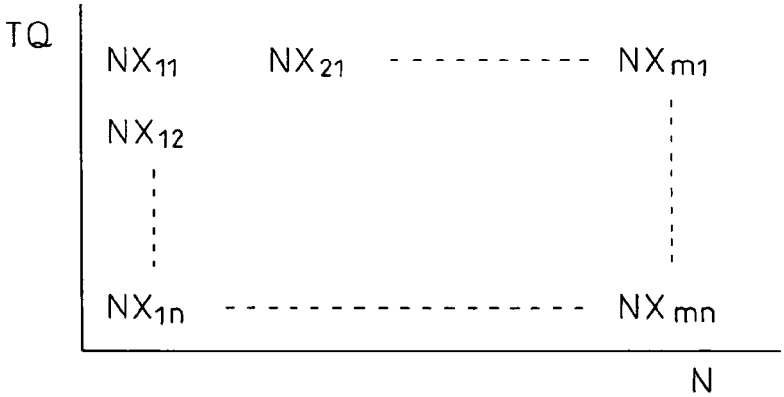

Next, the $NO_x$ release control will be explained while referring to FIG. 12 and FIG. 13.

FIG. 12(A) shows the change in the $NO_x$ amount ΣNOX stored in the $NO_x$ storing catalyst 12 and the timing for making the air-fuel ratio A/F of the exhaust gas rich for release of $NO_x$ at the time of engine low speed, low load operation, while FIG. 12(B) shows the change in the $NO_x$ amount ΣNOX stored in the $NO_x$ storing catalyst 12 and the timing for making the air-fuel ratio A/F of the exhaust gas rich for release of $NO_x$ at the time of engine high speed, high load operation.

The amount of $NO_x$ exhausted from the engine per unit time changes in accordance with the engine operating state, therefore the amount of $NO_x$ stored in the $NO_x$ storing catalyst 12 per unit time also changes in accordance with the engine operating state. In this embodiment of the present invention, the amount of $NO_x$ stored in the $NO_x$ storing catalyst 12 per unit time is stored as a function of the required torque TQ and the engine speed N in the form of a map shown in FIG. 13(A) in advance in the ROM 32. By cumulatively adding this $NO_x$ amount NOXA, the $NO_x$ amount ΣNOX stored in the $NO_x$ storing catalyst 12 is calculated.

On the other hand, in FIGS. 12(A) and (B), MAX indicates the maximum amount of $NO_x$ which the $NO_x$ storing catalyst 12 can store, while NX indicates the allowable value of the amount of $NO_x$ which can be made to be stored in the $NO_x$ storing catalyst 12. Therefore, as shown in FIGS. 12(A) and (B), when the $NO_x$ amount ΣNOX reaches the allowable value NX, the air-fuel ratio A/F of the exhaust gas flowing into the $NO_x$ storing catalyst 12 is made temporarily rich and thereby $NO_x$ is released from the $NO_x$ storing catalyst 12.

As explained above, at the time of engine low speed, low load operation, the amount of fuel which the HC adsorbing and oxidation catalyst 11 can adsorb increases, so the amount of fuel added from the fuel adding valve 14 is increased. If the amount of fuel added is increased in this way, the $NO_x$ storing catalyst 12 can be made to release a large amount of $NO_x$. That is, in this case, even when the $NO_x$ storing catalyst 12 stores a large amount of $NO_x$, all of the stored $NO_x$ can be released, so, as shown in FIG. 12(A), the allowable value NX is made a high value, in the embodiment shown in FIG. 12(A), a value just slightly lower than the maximum $NO_x$ stored amount.

As opposed to this, at the time of engine high speed, high load operation, the amount of fuel adsorbed by the HC adsorbing and oxidation catalyst 11 decreases, so as explained above, the amount of fuel added from the fuel adding valve 14 is reduced. If the amount of fuel added is reduced in this way, it is only possible to make the $NO_x$ storing catalyst 12 release a small amount of $NO_x$. That is, in this case, it is necessary to release the stored $NO_x$ after a small amount of $NO_x$ is stored in the $NO_x$ storing catalyst 12, so as shown in FIG. 12(B), the allowable value NX is made a considerably low value, in the embodiment shown in FIG. 12(B), a value of ⅓ or less of the allowable value NX at the time of engine low speed, low load operation shown in FIG. 12(A).

FIG. 13(B) shows the allowable value NX set in accordance with the engine operating state. In FIG. 13(B), the allowable value NX becomes gradually smaller in the order of $NX_1$, $NX_2$, $NX_3$, $NX_4$, $NX_5$, and $NX_6$. Note that the allowable value NX shown in FIG. 13(B) is stored in the form of a map as shown in FIG. 13(C) in advance in the ROM 32.

In this way, the higher the engine load or the higher the engine speed, the lower the allowable value NX, so to make the $NO_x$ storing catalyst 12 release $NO_x$, the higher the engine load or the higher the engine speed N, the higher the frequency of addition of particulate fuel from the fuel adding valve 14. That is, as shown in FIGS. 12(A) and (B), at the time of engine high speed, high load operation, the frequency of addition of particulate fuel becomes considerably higher compared with the time of engine low speed, low load operation.

On the other hand, the particulate matter contained in the exhaust gas is trapped on the particulate filter 12*a* carrying the $NO_x$ storing catalyst 12 and successively oxidized. However, if the amount of the particulate matter trapped becomes greater than the amount of the particulate matter oxidized, the particulate matter will gradually deposit on the particulate filter 12*a*. In this case, if the deposition of particulate matter increases, a drop in the engine output will end up being invited. Therefore, when the deposition of particulate matter increases, it is necessary to remove the deposited particulate matter. In this case, if raising the temperature of the particulate filter 12*a* under an excess of air to about 600° C., the deposited particulate matter is oxidized and removed.

Therefore, in this embodiment of the present invention, when the amount of the particulate matter deposited on the particulate filter 12*a* exceeds the allowable amount, the temperature of the particulate filter 12*a* is raised under a lean air-fuel ratio of the exhaust gas and thereby the deposited particulate matter is removed by oxidation. Specifically speaking, in this embodiment of the present invention, when the differential pressure ΔP before and after the particulate filter 12*a* detected by the differential pressure sensor 23 exceeds the allowable value PX, it is judged that the amount of deposited particulate matter has exceeded the allowable amount. At that time, the air-fuel ratio of the exhaust gas flowing into the particulate filter 12*a* is maintained lean, fuel is added from the fuel adding valve 14, and the heat of oxidation reaction of the fuel added raises the temperature of the particulate filter 12*a* in temperature raising control.

Figure 14:
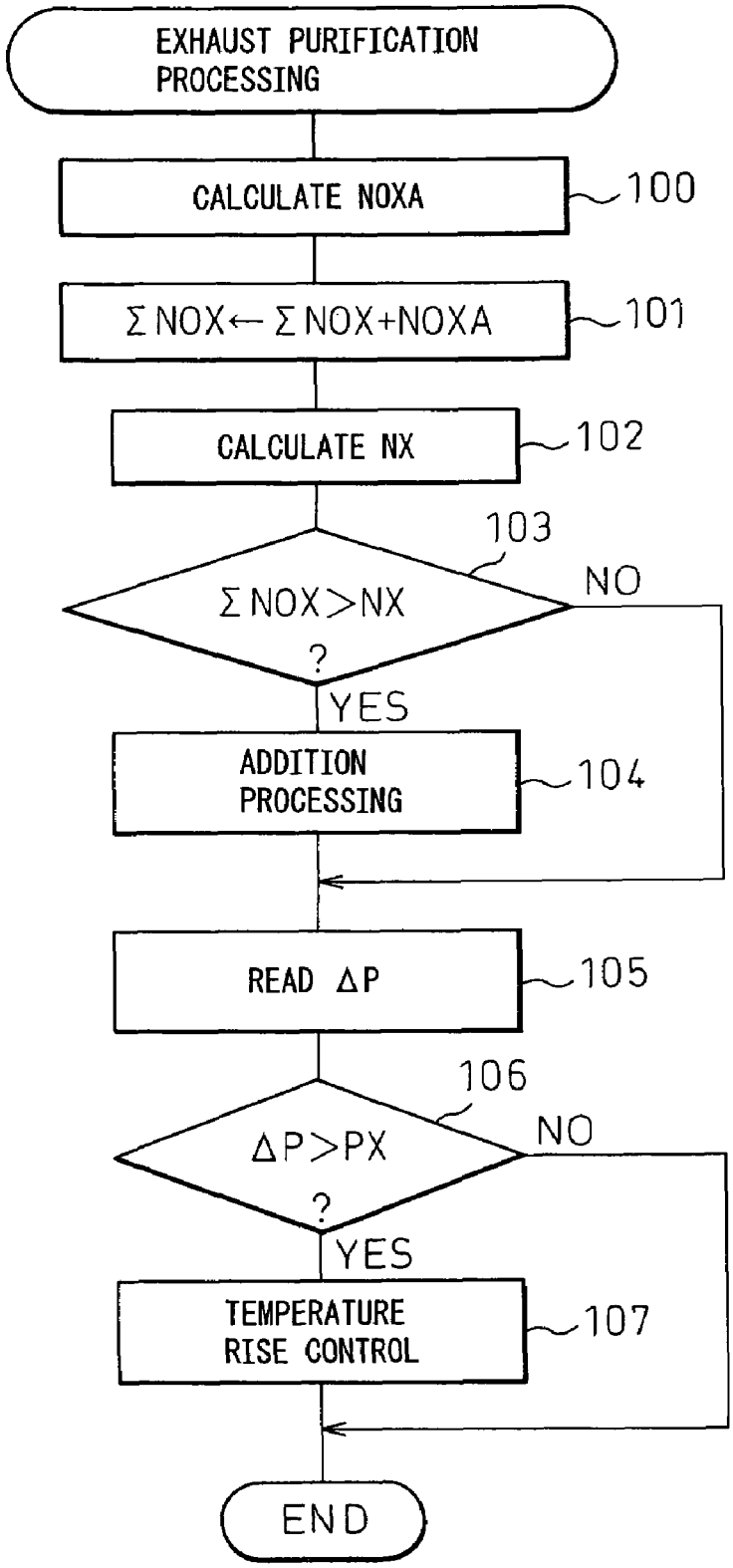
FIG. 14 is a flow chart of exhaust purification processing.

FIG. 14 shows the exhaust purification processing routine.

Figure 15:
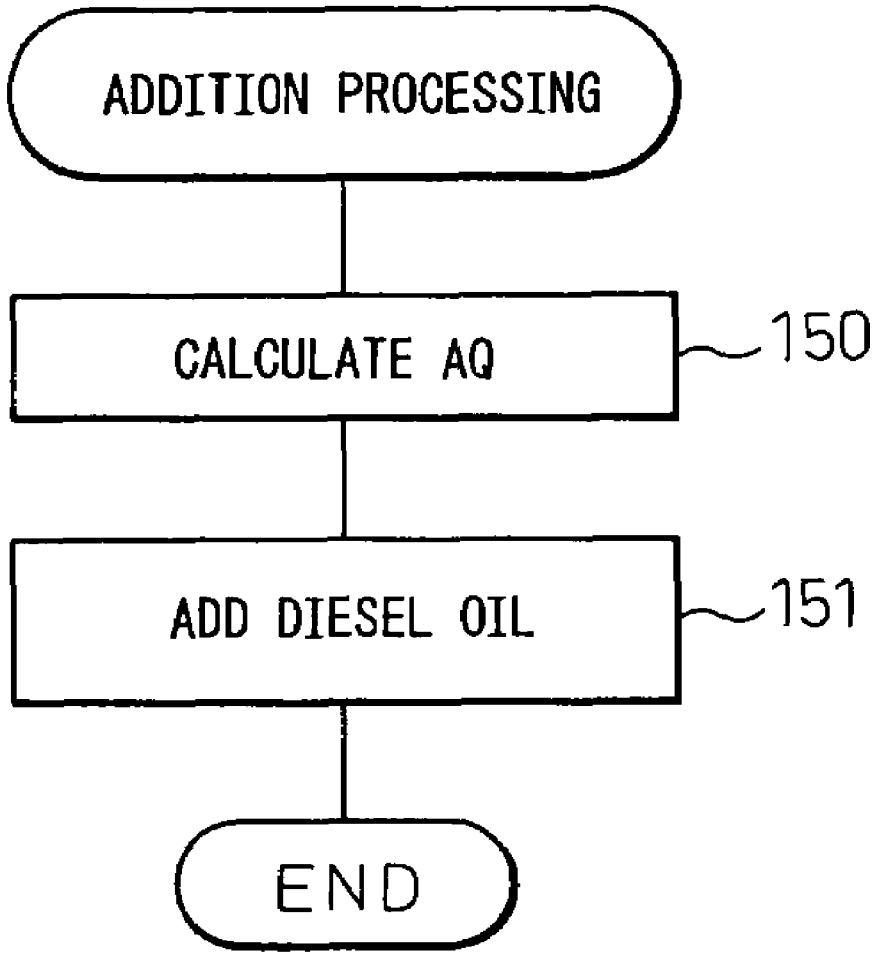
FIG. 15 is a flow chart of fuel addition processing.
Figure 16:
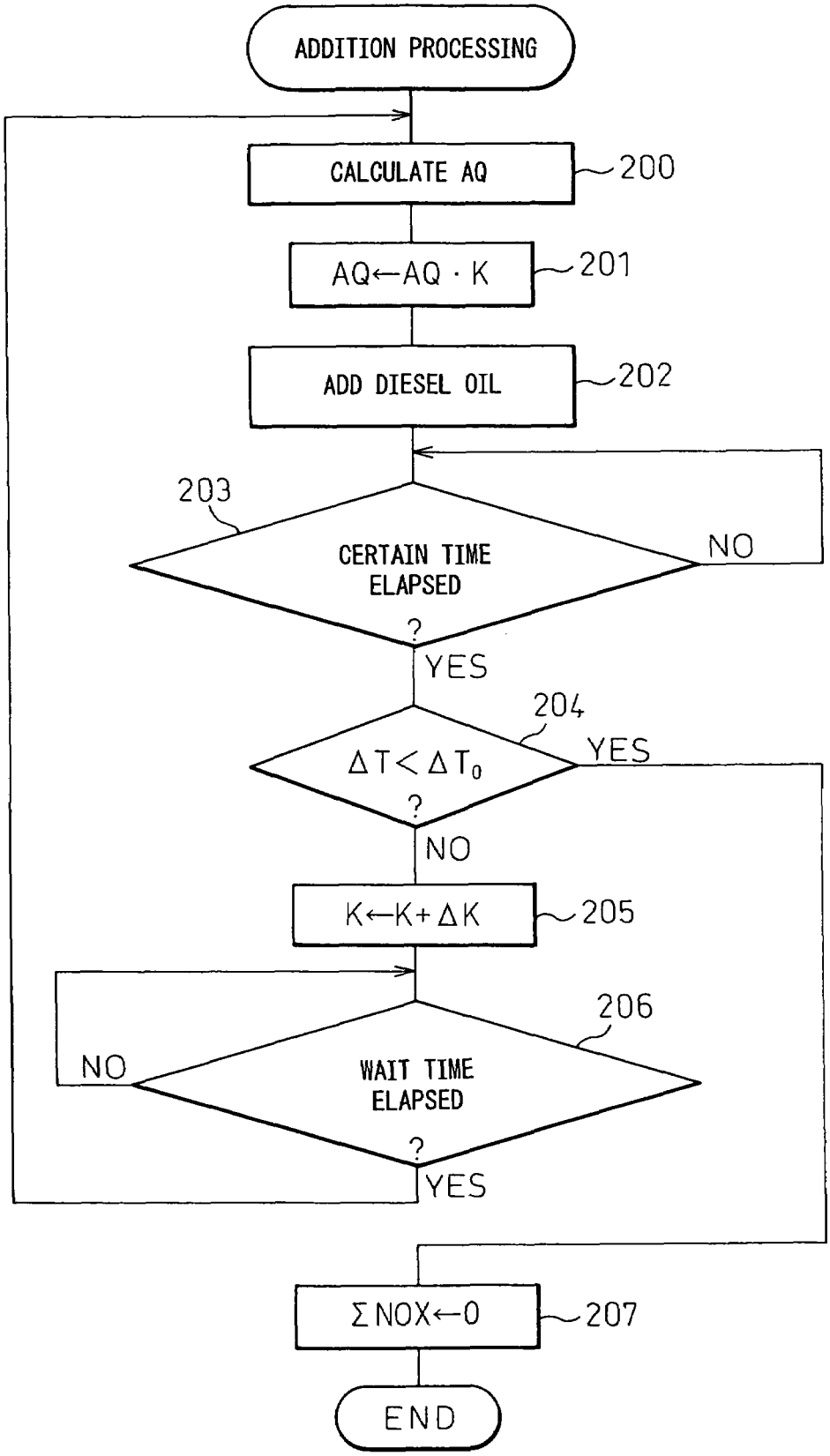
FIG. 16 is a flow chart of fuel addition processing.
Figure 17:
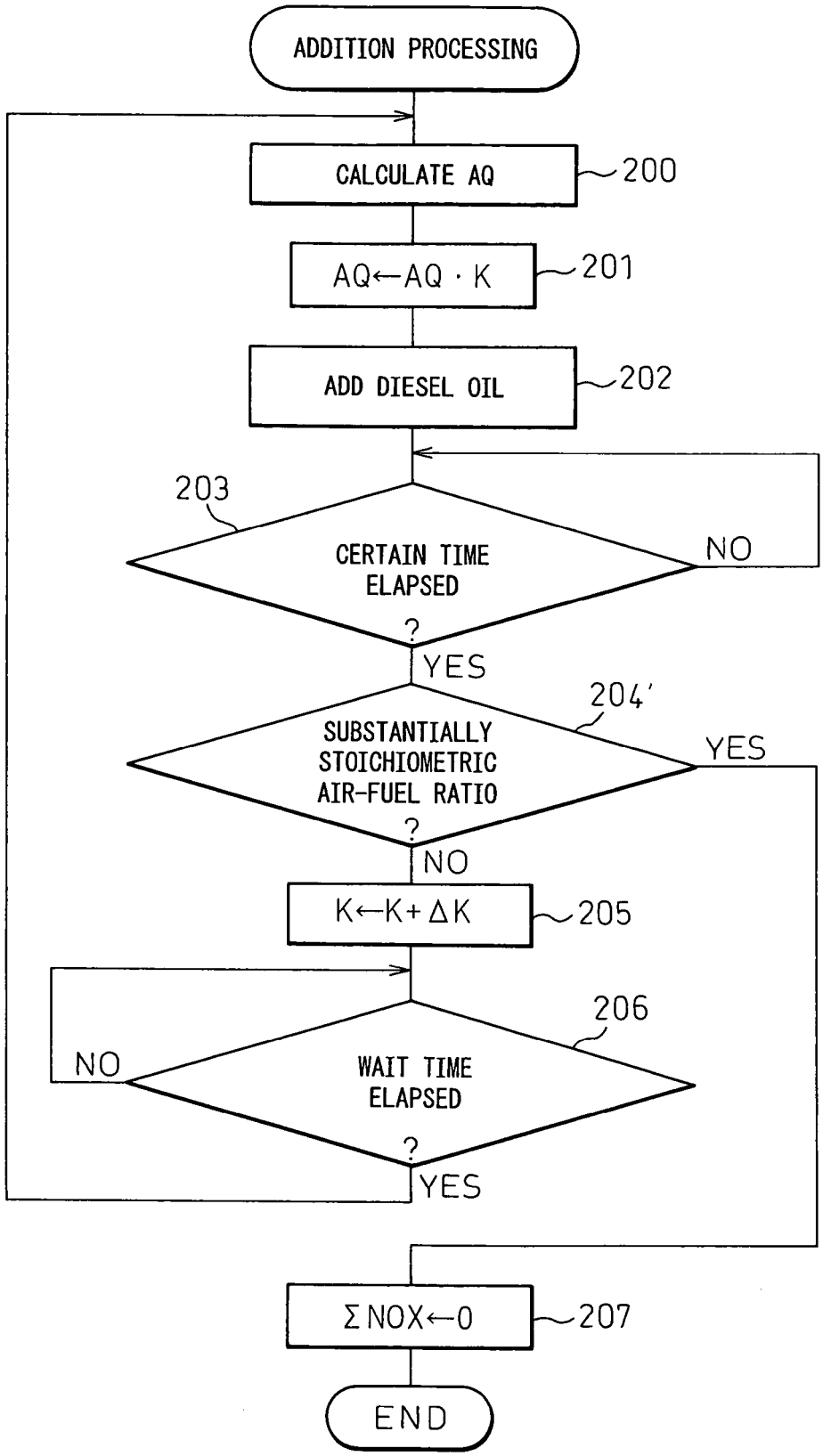
FIG. 17 is a flow chart of fuel addition processing.

Referring to FIG. 14, first, at step 100, the amount NOXA of $NO_x$ stored per unit time is calculated from the map shown in FIG. 13(A). Next, at step 101, this NOXA is added to the $NO_x$ amount ΣNOX stored in the $NO_x$ storing catalyst 12. Next, at step 102, the allowable value NX is calculated from the map shown in FIG. 13(C). Next, at step 103, it is judged if the stored $NO_x$ amount ΣNOX has exceeded the allowable value NX. When ΣNOX>NX, the routine proceeds to step 104, where processing is performed to add fuel from the fuel adding valve 14. A basic example of this fuel addition processing is shown in FIG. 15. Two examples of correction of the amount of addition are shown in FIG. 16 and FIG. 17. Next, at step 105, the differential pressure sensor 23 is used to detect the differential pressure ΔP before and after the particulate filter 12*a*. Next, at step 106, it is judged if the differential pressure ΔP has exceeded the allowable value PX. When ΔP>PX, the routine proceeds to step 107, where temperature raising control of the particulate filter 12*a* is performed.

FIG. 15 shows the basic fuel addition processing when $NO_x$ should be released from the $NO_x$ storing catalyst 12. In this basic fuel addition processing, first, at step 150, the amount of fuel AQ to be added is calculated from the map shown in FIG. 11(B), then at step 151, the fuel, that is, diesel oil, of the amount AQ calculated from the map is added from the fuel adding valve 14.

However, if the air-fuel ratio of the exhaust gas flowing into the $NO_x$ storing catalyst 12 does not become rich due to some sort of reason even if adding an amount AQ of fuel predetermined in accordance with the engine operating state, the $NO_x$ storing catalyst 12 will not release $NO_x$. Therefore, in this case, it is preferable to correct the amount of fuel added from the fuel adding valve 14 so that the air-fuel ratio of the exhaust gas flowing into the $NO_x$ storing catalyst 12 becomes rich. Therefore, in another embodiment of the present invention, provision is made of judging means for judging if the air-fuel ratio of the exhaust gas flowing out from the HC adsorbing and oxidation catalyst 11 has become rich when particulate fuel is added into the exhaust gas for making the $NO_x$ storing catalyst 12 release $NO_x$. When $NO_x$ should be released from the $NO_x$ storing catalyst 12, the amount of fuel required for making the air-fuel ratio of the exhaust gas flowing out from the HC adsorbing and oxidation catalyst 11 rich is added according to judgment by this judging means.

As already explained based on FIG. 9, when the air-fuel ratio of the exhaust gas flowing into the $NO_x$ storing catalyst 12 is rich, the temperature rise ΔT of the exhaust gas passing through the HC adsorbing and oxidation catalyst 11 becomes the reference value $\Delta T_0$ or more. Therefore, in the first example shown in FIG. 1, when the temperature difference between the temperature detected by the temperature sensor 21 and the temperature detected by the temperature sensor 22, that is, the temperature rise ΔT, has exceeded the reference value $\Delta T_0$, it is judged that the air-fuel ratio of the exhaust gas flowing out from the HC adsorbing and oxidation catalyst 11 has become rich.

On the other hand, as shown in FIGS. 8(B) and (C) or FIGS. 10(B) and (C), when the air-fuel ratio A/F of the exhaust gas flowing out from the HC adsorbing and oxidation catalyst 11 becomes just slightly rich, the air-fuel ratio A/F of the exhaust gas flowing out from the $NO_x$ storing catalyst 12 becomes substantially the stoichiometric air-fuel ratio. Therefore, in the second example shown in FIG. 2, the air-fuel ratio sensor 26 is provided so as to detect the air-fuel ratio of the exhaust gas flowing out from the $NO_x$ storing catalyst 12. When the air-fuel ratio of the exhaust gas detected by the air-fuel ratio sensor 26 is substantially the stoichiometric air-fuel ratio, it is judged that the air-fuel ratio of the exhaust gas flowing out from the HC adsorbing and oxidation catalyst 11 is rich.

Note that in the embodiment shown in FIG. 1 and FIG. 2, when it is judged that the air-fuel ratio of the exhaust gas flowing out from the HC adsorbing and oxidation catalyst 11 is not rich, the amount of particulate fuel added from the fuel adding valve 14 is increased. The action of increase of the amount of fuel added is performed for example by increasing the pulse like fuel addition time.

On the other hand, when it is judged that the air-fuel ratio of the exhaust gas flowing out from the HC adsorbing and oxidation catalyst 11 is not rich, the action of addition of fuel from the fuel adding valve 14 is already completed. Therefore, at this time, when it is next judged that the $NO_x$ storing catalyst 12 should release $NO_x$, the amount of particulate fuel added from the fuel adding valve 14 is increased.

FIG. 16 shows the fuel addition control in the case of using the temperature sensors 21 and 22 to detect the temperature rise $\Delta T$ of the exhaust gas passing through the HC adsorbing and oxidation catalyst 11 in FIG. 1.

Referring to FIG. 16, first, at step 200, the amount of fuel added AQ is calculated from the map shown in FIG. 11(B). Next, at step 201, the amount of fuel added AQ is multiplied with a correction coefficient K to calculate the final amount of fuel added AQ (=AQ·K). Next, at step 202, fuel, that is, diesel oil, is added from the fuel adding valve 14 in accordance with the final amount of fuel added AQ.

Next, at step 203, the elapse of a certain time from the addition of the fuel is awaited. When that certain time has elapsed, the routine proceeds to step 204, where it is judged based on the output signals of the temperature signals 21 and 22 if the temperature rise $\Delta T$ is lower than a reference value $\Delta T_0$. When it is judged that $\Delta T \geqq \Delta T_0$, the routine proceeds to step 207, where $\Sigma NOX$ is cleared, then the processing cycle is ended. When it is judged that $\Delta T < \Delta T_0$, the routine proceeds to step 205.

At step 205, the correction coefficient K is increased by a certain value $\Delta K$, then at step 206 the elapse of a predetermined wait time, that is, the consumption of the added fuel, is awaited. When the wait time elapses, the routine proceeds through step 200 to step 201 and step 202, whereby a larger amount of fuel than the previous time is added.

FIG. 17 shows the fuel addition control in the case of detecting the air-fuel ratio A/F of the exhaust gas flowing out from the $NO_x$ storing catalyst 12 by an air-fuel ratio sensor 26 as shown in FIG. 2.

In the routine shown in FIG. 17, the only difference from the routine shown in FIG. 16 is step 204'. Therefore, only step 204' of the routine shown in FIG. 17 will be explained.

Referring to FIG. 17, at step 204', it is judged based on the output signal of the air-fuel ratio sensor 26 whether the air-fuel ratio A/F of the exhaust gas flowing out from the $NO_x$ storing catalyst 12 is about the stoichiometric air-fuel ratio. When it is judged that it is about the stoichiometric air-fuel ratio, the routine proceeds to step 207, while when it is judged that it is not about the stoichiometric air-fuel ratio, the routine proceeds to step 205.

The invention claimed is:

1. An exhaust purification device for a compression ignition type internal combustion engine comprising:

a combustion chamber;

an engine exhaust passage separate from the combustion chamber;

fuel adding means for injecting particulate fuel into the engine exhaust passage;

an HC adsorbing and oxidation catalyst arranged in the engine exhaust passage downstream of the fuel adding means for adsorbing and oxidizing hydrocarbons contained in exhaust gas; and an $NO_x$ storing catalyst arranged in the engine exhaust passage downstream of the HC adsorbing and oxidation catalyst for storing $NO_x$ contained in the exhaust gas when an air-fuel ratio of the inflowing exhaust gas is lean and releasing the stored $NO_x$ when the air-fuel ratio of the inflowing exhaust gas becomes a stoichiometric air-fuel ratio or rich, wherein particulate fuel is added from the fuel adding means when making the air-fuel ratio of the exhaust gas flowing into the $NO_x$ storing catalyst rich to make the $NO_x$ storing catalyst release $NO_x$, the amount of addition of particulate fuel at this time is set to an amount whereby the air-fuel ratio of the exhaust gas flowing into the HC absorbing and oxidation catalyst becomes a rich air-fuel ratio smaller than the rich air-fuel ratio when flowing into the $NO_x$ storing catalyst, and after the added particulate fuel is adsorbed at the HC adsorbing and oxidation catalyst, and the majority of the adsorbed fuel is oxidized in the HC adsorbing and oxidation catalyst and the air-fuel ratio of the exhaust gas flowing into the $NO_x$ storing catalyst is made rich over a longer period than when the air-fuel ratio of the exhaust gas flowing into the HC adsorbing and oxidation catalyst is made rich.

2. An exhaust purification device as set forth in claim 1, wherein an amount of particulate fuel to be added from said fuel adding means for making the $NO_x$ storing catalyst release $NO_x$ is set to an amount giving an air-fuel ratio of the exhaust gas flowing into the HC adsorbing and oxidation catalyst about 1 to about 7 at the time of engine low speed, low load operation.

3. An exhaust purification device as set forth in claim 1, wherein the amount of particulate fuel added from said fuel adding means for making the $NO_x$ storing catalyst release $NO_x$ is reduced the higher the temperature of the HC adsorbing and oxidation catalyst.

4. An exhaust purification device as set forth in claim 1, wherein the amount of addition of particulate fuel from said fuel adding means for making the $NO_x$ storing catalyst release $NO_x$ is reduced the greater the flow rate of the exhaust gas.

5. An exhaust purification device as set forth in claim 1, wherein the amount of addition of particulate fuel from said fuel adding means for making the $NO_x$ storing catalyst release $NO_x$ is made smaller at the time of engine high speed, high load operation compared with the time of engine low speed, low load operation.

6. An exhaust purification device as set forth in claim 1, wherein the frequency of addition of particulate fuel from said fuel adding means for making the $NO_x$ storing catalyst release $NO_x$ is higher the higher the engine load.

7. An exhaust purification device as set forth in claim 1, wherein particulate fuel is added from said fuel adding means to make the $NO_x$ storing catalyst release $NO_x$ when the amount of $NO_x$ stored in the $NO_x$ storing catalyst exceeds an allowable value, and the allowable value is made lower the higher the engine load.

8. An exhaust purification device as set forth in claim 1, wherein a precious metal catalyst is carried on a base of said HC adsorbing and oxidation catalyst.

9. An exhaust purification device as set forth in claim 1, wherein a base of said HC adsorbing and oxidation catalyst includes zeolite.

10. An exhaust purification device as set forth in claim 1, where said device comprises judging means for judging if the air-fuel ratio of the exhaust gas flowing out from the HC adsorbing and oxidation catalyst has become rich when particulate fuel is added into the exhaust gas to make the $NO_x$ storing catalyst release $NO_x$, and said fuel adding means adds fuel of the amount necessary for making the air-fuel ratio of the exhaust gas flowing out from the HC adsorbing and oxidation catalyst rich in accordance with the judgment of said judging means when making the $NO_x$ storing catalyst release $NO_x$.

11. An exhaust purification device as set forth in claim 10, wherein temperature sensors able to detect a temperature rise of exhaust gas flowing out from the HC adsorbing and oxidation catalyst are arranged in the engine exhaust passage, and said judging means judges that the air-fuel ratio of the exhaust gas flowing out from the HC adsorbing and oxidation catalyst has become rich when said temperature rise exceeds a reference value.

12. An exhaust purification device as set forth in claim 10, wherein an air-fuel ratio sensor able to detect the air-fuel ratio of the exhaust gas flowing out from the $NO_x$ storing catalyst is arranged in the engine exhaust passage downstream of the $NO_x$ storing catalyst, and said judging means judges that the air-fuel ratio of the exhaust gas flowing out from the HC adsorbing and oxidation catalyst has become rich when the air-fuel ratio of the exhaust gas detected by the air-fuel ratio sensor is substantially the stoichiometric air-fuel ratio.

13. An exhaust purification device as set forth in claim 11, wherein when said judging means judges that the air-fuel ratio of the exhaust gas flowing out from the HC adsorbing and oxidation catalyst is not rich, said fuel adding means increases the amount of particulate fuel added from the fuel adding means.

14. An exhaust purification device as set forth in claim 13, wherein when said judging means judges that the air-fuel ratio of the exhaust gas flowing out from the HC adsorbing and oxidation catalyst is not rich, said fuel adding means increases the amount of particulate fuel added from the fuel adding means when it is next judged that $NO_x$ should be released from the $NO_x$ storing catalyst.

15. An exhaust purification device as set forth in claim 12, wherein when said judging means judges that the air-fuel ratio of the exhaust gas flowing out from the HC adsorbing and oxidation catalyst is not rich, said fuel adding means increases the amount of particulate fuel added from the fuel adding means.

16. An exhaust purification device as set forth in claim 1, wherein the $NO_x$ storing catalyst is carried on a particulate filter for trapping and oxidizing particulate matter contained in the exhaust gas.

17. An exhaust purification device as set forth in claim 16, wherein raises the temperature of the particulate filter is raised under a lean air-fuel ratio of the exhaust gas when the amount of particulate matter deposited on the particulate filter exceeds an allowable amount and thereby the deposited particulate matter is removed by oxidation.

* * * * *